US006423155B1

(12) United States Patent
Chang et al.

(10) Patent No.: US 6,423,155 B1
(45) Date of Patent: Jul. 23, 2002

(54) HIGH STRENGTH METAL ALLOYS WITH HIGH MAGNETIC SATURATION INDUCTION AND METHOD

(75) Inventors: Y. Grant Chang, Irvine; Norman E. Farb, Villa Park, both of CA (US)

(73) Assignee: Printronix, Inc., Irvine, CA (US)

( * ) Notice: Subject to any disclaimer, the term of this patent is extended or adjusted under 35 U.S.C. 154(b) by 0 days.

(21) Appl. No.: 09/652,358

(22) Filed: Aug. 29, 2000

Related U.S. Application Data

(62) Division of application No. 09/089,617, filed on Jun. 3, 1998, now Pat. No. 6,146,033.

(51) Int. Cl.[7] ..... H01F 1/147
(52) U.S. Cl. ..... 148/120; 148/120
(58) Field of Search ..... 148/120, 121, 148/122

(56) References Cited

U.S. PATENT DOCUMENTS

| | | | | |
|---|---|---|---|---|
| 3,636,579 A | | 1/1972 | Sakakura et al. | |
| 3,673,010 A | | 6/1972 | Matsumoto et al. | |
| 3,867,135 A | | 2/1975 | Johnsson et al. | |
| 3,948,691 A | | 4/1976 | Matsushita | |
| 4,059,462 A | * | 11/1977 | Masumoto et al. | 148/121 |
| 4,076,525 A | | 2/1978 | Little et al. | |
| 4,098,607 A | | 7/1978 | Rizzitano et al. | |
| 4,152,144 A | | 5/1979 | Hasegawaet et al. | |
| 4,221,592 A | | 9/1980 | Ray | |
| 4,319,934 A | | 3/1982 | Henning | |
| 4,340,434 A | * | 7/1982 | Jin et al. | 148/101 |
| 4,881,989 A | | 11/1989 | Yoshizawa et al. | |
| 4,999,053 A | | 3/1991 | Ototani et al. | |
| 5,024,542 A | | 6/1991 | Tanaka | |
| 5,045,637 A | | 9/1991 | Sato et al. | |
| 5,087,415 A | | 2/1992 | Hemphill et al. | |
| 5,252,940 A | | 10/1993 | Tanaka | |
| 5,268,044 A | | 12/1993 | Hemphill et al. | |
| 5,335,999 A | | 8/1994 | Farb et al. | |

FOREIGN PATENT DOCUMENTS

| | | |
|---|---|---|
| GB | 1 182 826 | 4/1970 |
| JP | 51-092097 | 8/1976 |
| JP | 56-023250 | 3/1981 |

OTHER PUBLICATIONS

Patent Abstracts of Japan, vol. 98, No. 002, Jan. 30, 1998 Abstract of JP 09 263907 A, Jul. 10, 1997.

Metals Handbook, vol. 2, Properties and Selection: Nonferrous Alloys and Special–Purpose Materials; ASM International (American Society for Metals) 1990: Fig. 4, p. 763.

Handbook of Chemistry and Physics, 56th Edition, 1975–1976 pp. E–116 to E–122.

* cited by examiner

*Primary Examiner*—John Sheehan
(74) *Attorney, Agent, or Firm*—George F. Bethel

(57) ABSTRACT

A new high strength steel alloy characterized by having high DC magnetic saturation, ultra high tensile, yield and fatigue strengths that is particularly suited for use as a hammer-spring in hammerbanks in impact printers and for other applications where magnetic alloys are used and high mechanical strength is desirable. The alloy is formed of the following composition in weight percent: about 20% to about 35% Co; about 2% to about 6.0% Ni; about 0.0 to about 0.15% C; about 0.75% to about 3% Mo; 0% to about 3.0% Cr; 0% to about 2% Mu; 0% to about 0.02% Si; 0% to about 0.003% P; 0% to about 0.001% S; 0% to about 0.005% $0_2$+$N_2$;with the balance comprised of Fe. A process for making the alloy includes homogenizing preferably at a temperature of 2150° F. for 24 hours, and solution treating at a temperature in the range of about 1500° F. to about 1700° F. under a vacuum or inert gas protective atmosphere; air-cooling; and precipitation aging at a temperature in the range of about 800° F. to about 1100° F. for about 6 to about 36 hours.

20 Claims, 18 Drawing Sheets

Fatigue (S-N) Test Results of Alloy Example 1.

Microstructure of Alloy Example 1 with Lamellar features. Sample was heat treated at 1600 °F for 2 hours, air-cooled, aged at 990 °F for 14 hours, Magnification: 600X Microstructure of Sample 1-14, Magnification: 600X Microstructure of Sample 1-20, Magnification: 600X Figure 7: Alloy Example 1 Solution at 1610 ± 10 °F Aged at 950 ± 10 °F for 24 Hrs.

Figure 8: Alloy Example 1 Solution at 1610 ± 10° F Aged at 950 ± 10 °F for 36 Hrs.

Figure 9: Fatigue (S-N) Test Results of Alloy Example 1.

Figure 10: Alloy Example 2 Solution at 1570 ± 10 °F Aged 1015 ± 10°F 16 Hrs.

Typical Microstructure of Sample 2-5, Magnification 600X

Typical Microstructure of Sample 2-12, Magnification 600X

Typical Microstructure of Sample 2-18, Magnification 600X

Figure 14: Fatigue (S-N) Test Results of Alloy Example 2.

Figure 15: Alloy Example 3 Solution At 1650 ± 10° F Aged 1000 ± 10° F 18 Hrs..

Typical Microstructure of Sample 3-12, Magnification 600X

Typical Microstructure of Sample 3-22, Magnification 600X

Typical Microstructure of Sample 3-35, Magnification 600X

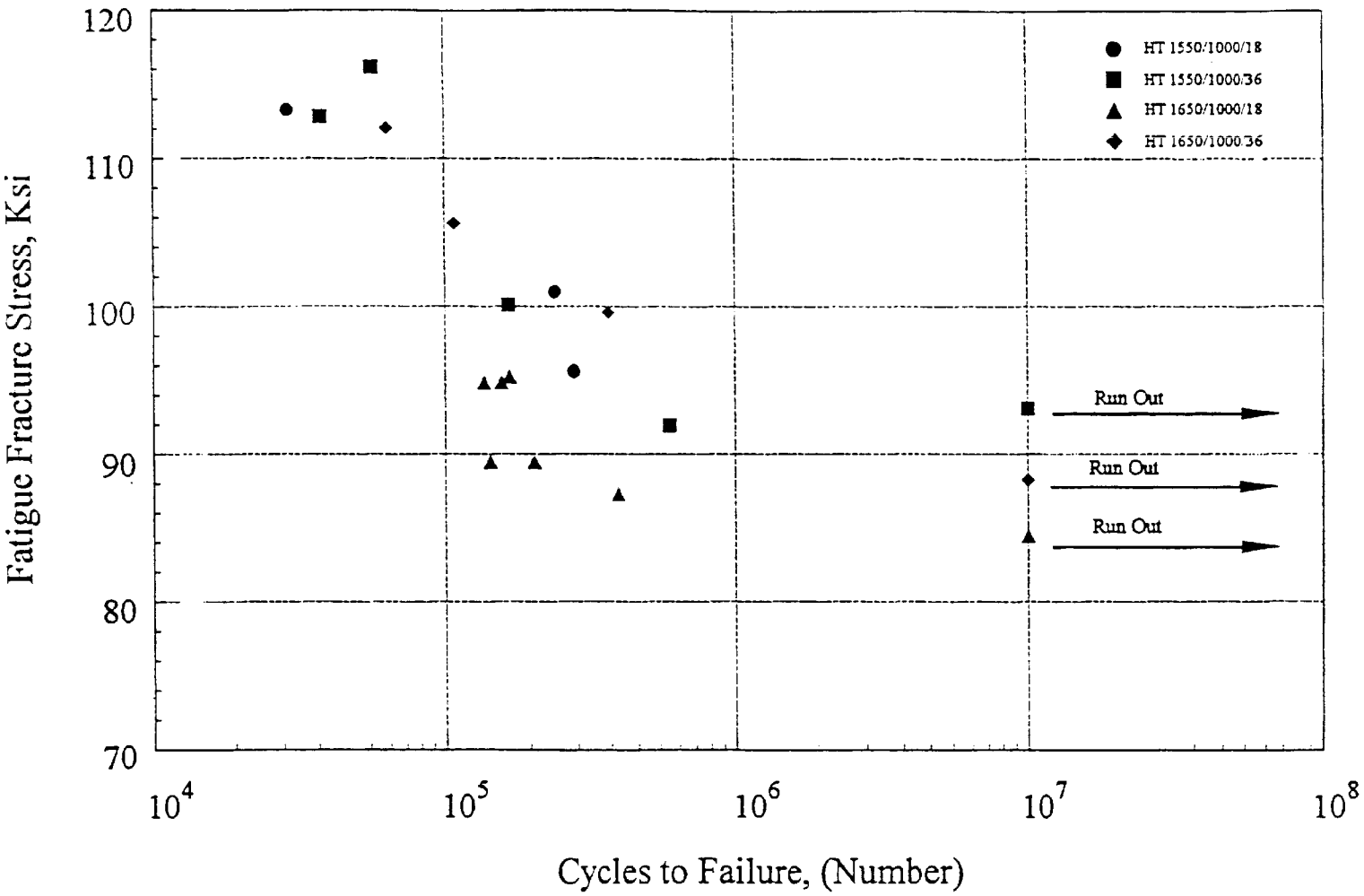
Figure 19: Fatigue (S-N) Test Results of Alloy Example 3.

HIGH STRENGTH METAL ALLOYS WITH HIGH MAGNETIC SATURATION INDUCTION AND METHOD

This application is a division of application Ser. No. 09/089,617, filed Jun. 3, 1998, now U.S. Pat. No. 6,146,033.

FIELD OF THE INVENTION

This invention relates to the field of magnetic alloys and particularly to magnetic alloys and to a process for manufacture wherein the alloys are characterized by having high tensile and fatigue strength and high saturation induction for use in impact printers, automobile internal combustion engine valves, and other applications where magnetic alloys are used and high strength is desirable.

BACKGROUND OF THE INVENTION

Impact printers utilize a plurality of print hammers or hammersprings arranged in a hammerbank. The print hammers or hammersprings are held before release by means of permanent magnetism.

The individual print hammers are formed of a single piece of steel plate which is ground and electro-discharge machined into a spring member or hammerspring having preferably a relatively thin tapered neck capped by a head. Each print hammer or hammerspring has a tip, pin or wire at the head end for impacting a ribbon. The ribbon impacting is then received as a printed dot on paper that is to be printed upon and which is supported by a platen.

The upper part or head of the print hammer or hammerspring is held in a retracted position by a permanent magnetic force against a pole piece until released. When the permanent magnetic force is overcome or nullified by current flow or electrical discharge through electrical coils, the print hammer is released. This causes the tip, pin or wire of the head of tile print hammer or hammerspring to forcibly and rapidly contact the ribbon to effectuate a printing against the ribbon onto the paper. Immediately thereafter, the print hammer is captured again and held by the permanent magnetic force.

The print hammer or hammerspring acts like a spring by flexing along its neck. When held by the magnetic force, the print hammer is held under a bending moment or tension. Desirably, the print hammer is made of a high strength alloy steel, which can be placed under high tension to give the high energy at the time of release, which generates higher printing energy. At the same time the material must have a high magnetic saturation to secure the hammer magnetically against the pole pieces. Higher saturation induction of the hammerspring steel allows higher flux carrying capacity. This could effectively reduce the volume of the steel in the area contacting the pole pieces and increase the speed of moving, which results is a lighter speed of printing. Another desirable quality is strength and toughness of the steel, so that the hammerspring or print hammer will have a life consonant with that of the printer.

While high purity iron produces a very high magnetic saturation (21.8 kilogauss (KG)), it lacks the mechanical strength needed. Alloy steels after proper heat treatment, depending upon the grade used, have acceptable mechanical and fatigue strengths, but lack adequate direct current (DC) magnetic saturation for the design optimizations.

Currently available ultra high strength steels, such as 300M, 4340 and tool steels, all have high carbon (C) concentrations that cause inferior magnetic properties. In addition, the usage of carbon as the main hardening element increases the formations of $M_3C$, $M_6C$ and $M_{23}C_6$ (M=Fe, Cr, Mo, W, V and etc.), and stabilizes the lath form of martensite structure during the conventional water or oil quenching operations to increase both tensile and yield strengths.

At the same time, the presence of the high concentration of carbon in the steel reduces magnetic saturation and permeability of the steel. In certain instances, it also reduces the toughness and fatigue resistance. In contrast to the conventional quench-and-harden high strength steels, there are several types of steel, which have exceptional high fatigue resistance that are hardened without utilizing the conventional quench hardening process. Instead, these steel alloys use the inert gas or air as the quench media and use the precipitation hardening process as the strengthening mechanisms. These alloys are highly desirable for hammerspring applications since they have much better dimensional stability and contain very little quench stress.

The secondary hardening martensitic steels are hardened by carbide precipitation mechanisms that require considerable amounts of nickel and cobalt. They require a solution heat treatment that is conducted at about 1600° F. and then air-cooled to produce martensitic structure. After solution heat treating, these steels are subjected to a precipitation hardened process which is conducted at around 950° F. to produce tempered lath martensitic and to achieve the optimal mechanical properties.

The resulting final microstructure has good resistance to the dislocation recovery even at an ageing temperature of 950° F. or higher. Also, when combined with the addition of small amounts of Mo, Cr, W and V, these types of steel alloys can form $M_2C_x$ type carbide precipitates to inhibit the microvoid nucleation so as to strengthen the steels. These $M_2C_x$ types of carbides, unlike the $M_3C$, $M_6C$ or $M_{23}C_6$, are more favorable carbide precipitates that increase the toughness and fatigue strength. These are the major factors that make the secondary hardening steels extremely attractive to those applications requiring high strength, high hardness, and high fatigue resistance. Examples of such steels are those commercially available Carpenter Aermet 100 and AF1410 steels, which have excellent mechanical properties.

However, the secondary hardening martensitic steel alloys require the addition of relatively high concentrations of carbon and other elements to increase the final mechanical properties. This makes this type of steel not suitable for the applications requiring both high mechanical strength and high saturation induction. Neither Carpenter Aermet 100 steel nor AF1410 steel is designed for the applications that also require greater magnetic saturation.

The addition of Co to the steel alloys is an effective way to increase the magnetic saturation of the steel alloys. Theoretically, the Fe—Co binary alloy gets to the highest saturation induction, 24.2 kilogauss (KG), with 35 to 37% of cobalt. However, there is an inherent brittleness problem associated with the binary Fe—Co alloy.

Adding Ni into the Fe—Co matrix tends to decrease the total saturation magnetization. The presence of high concentrations of Ni may result in the formation of austenite, a Face-Center-Cubic (FCC) non-magnetic phase, during the heat treatment. However, Ni is also required to lower the $M_s$ temperature and to promote the formation of lath martensite, which is the key alloy element for getting good mechanical strength.

On of the drawbacks associated with the Fe—Co—Ni ternary alloy is that the Fe—Co—Ni solid solution can only be hardened mechanically, but not thermally. Severe mechanical cold working significantly degrades the magnetic properties as well as the stability of the alloy due to the resulting cold-work residual stresses. An annealing process is therefore required to restore both the magnetic properties and alloy workability, and consequently reduce the inherited tensile and yield strengths. Therefore, other alloy elements need to be added to the Fe—Co—Ni alloy to make it possible for the applications, which demand high mechanical strength.

It is an object of the invention to provide the optimal chemical composition of age-hardening steel to achieve the best possible combination of the magnetic saturation induction and the mechanical properties for the hammerspring applications.

It is another object of this invention to provide the optimal Ni concentration of the Fe—Co—Ni alloy steel and also to provide the required optimal amounts of the hardening elements, such as C, Cr, Mo, W, and V, to the Fe—Co—Ni alloy matrix to increase mechanical strengths.

It is a further object of the invention to provide an age hardened steel alloy having high tensile, yield and fatigue strengths, coupled with good soft magnetic properties including high saturation induction.

It is another object of the invention to provide age hardened steels containing more than 20% by weight of Co and less than about 6% of Ni, which preferentially form low carbon martensite matrix or the mixtures of martensite and ferrite, rather than the simple ferrite phase, depending upon the solution heat treatment and ageing temperatures.

It is another object of the invention to provide a method for manufacture of age hardened steel alloys characterized by high tensile, yield and fatigue strengths and high saturation induction without any liquid-quench process.

It is another object of the invention to provide Fe—Co—Ni alloys having high tensile, yield and fatigue strengths and high saturation induction, which are particularly suited for use as hammerspring material for impact printers, and other applications where high saturation induction and high strength are desirable.

It is a final object of the invention to provide a printer hammerspring and a printer hammerbank formed of the alloys of the invention and a printer incorporating the hammerspring and hammerbank.

SUMMARY OF THE INVENTION

It has now been discovered that the above desirable qualities of high tensile, yield and fatigue strengths and high saturation induction can be found in alloys or steels formed of iron (Fe), cobalt (Co), and nickel (Ni), comprising in percent by weight between about 20% and about 35% Co; about 2% to about 6% Ni; 0% to about 0.15% C; about 0.75 to about 3% molybdenum (Mb), 0% to about 3% chromium (Cr), 0% to about 2% Mn with the balance comprised of iron (Fe). The total other elements and impurities, such as Si, S, P, O and N content shall be kept as low as practically possible.

The process for manufacture of the alloys is also important to the final mechanical strengths and magnetic properties. These steps include melting, forming, homogenizing, rolling, solution heat treating, air-cooling and precipitation aging. In particular, the solution treating temperature and the precipitation temperature and time are the most important parameters for getting the optimal final properties.

Examples of specific alloys of the invention are characterized by high mechanical strength including a minimum yield strength of 130,000 ksi (kilopounds per square inch), a minimum tensile strength of 170 ksi, with elongation (2-inch gauge) in the range of 5% to about 18%, a minimum Rockwell Hardness (C Scale) of HRC 36, and a magnetic saturation induction, $B_{max}$, of 21.8 KG (kilogauss) minimum at 560 Oersteads (Oe).

A printer hammerspring and a printer hammerbank formed of the alloys of the invention and a printer incorporating the hammerspring and hammerbank are also provided by the invention.

The invention will be more readily understood by the description to follow taken with the attached drawings.

BRIEF DESCRIPTION OF THE DRAWINGS

FIGS. 4–19 shows B/H curves, photomicrographs and fatigue stress-cycle (S/N) curves of specific preferred alloy compositions made according to the invention.

DETAILED DESCRIPTION

DOT MATRIX PRINTERS EMPLOYING HAMMERSPRINGS

Figure 1:
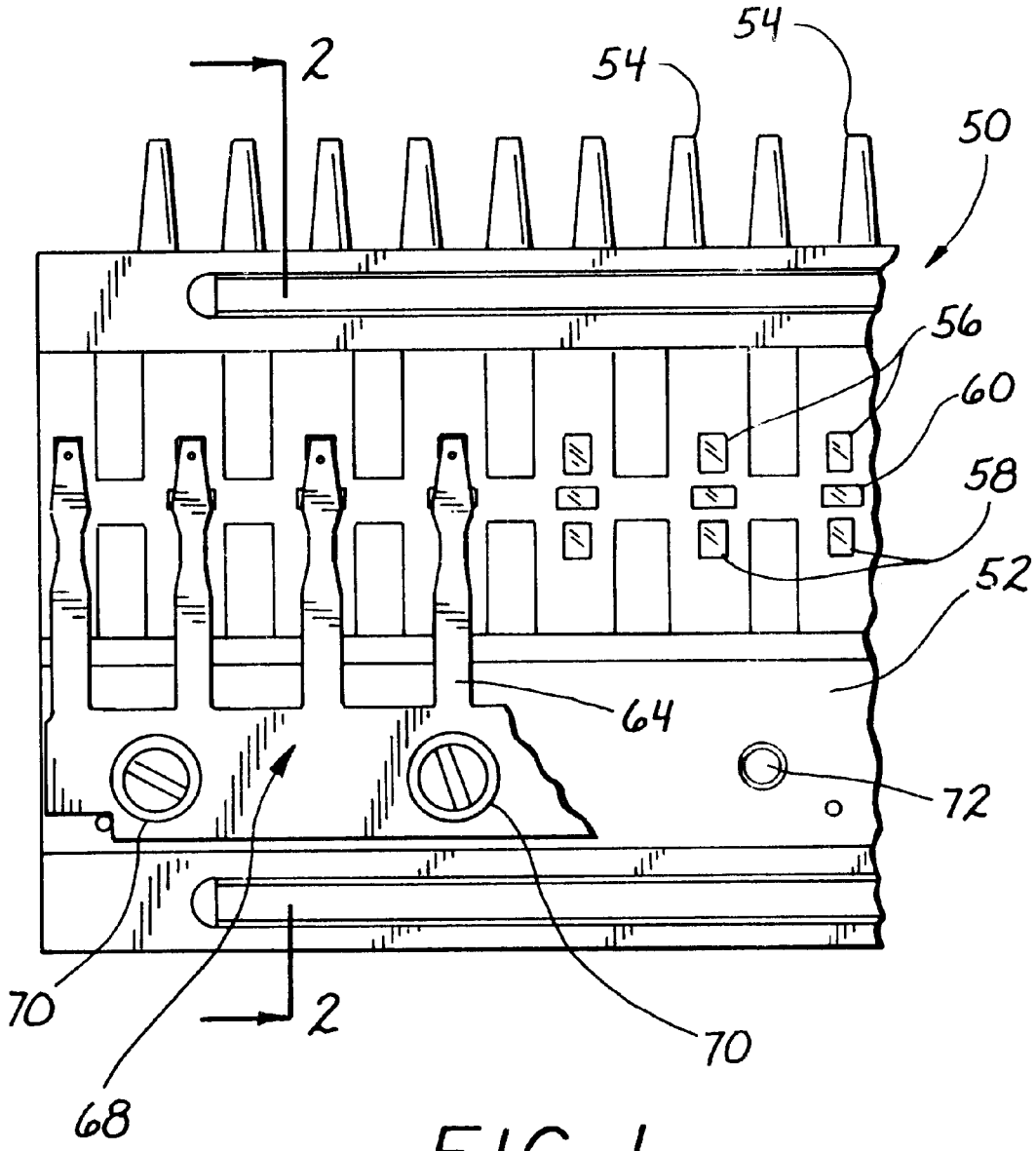
FIG. 1 shows a fragmented front elevation view of a hammerbank with the hammersprings formed of the alloys of the invention.
Figure 2:
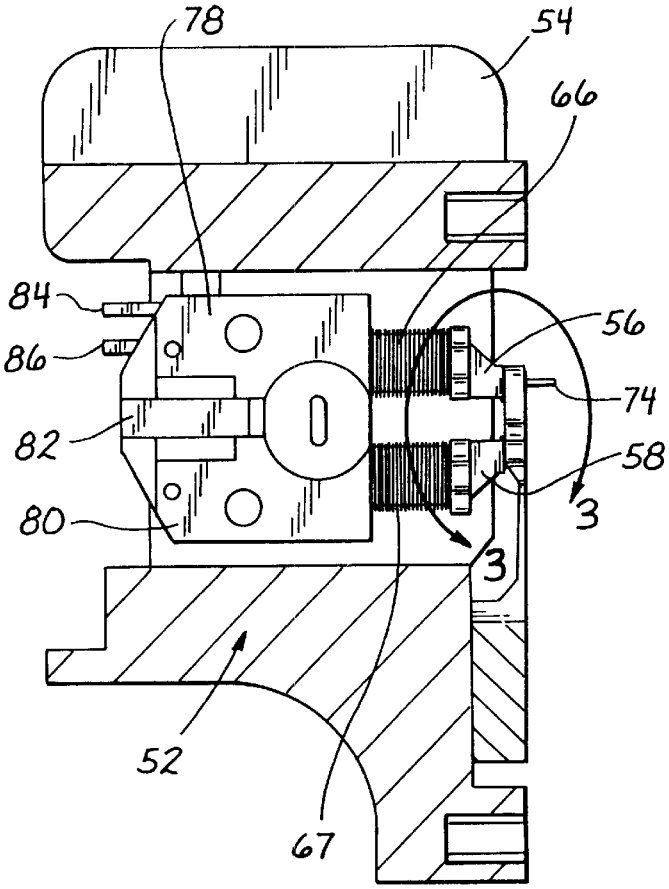
FIG. 2 shows a detailed sectional view through the hammerbank of FIG. 1 in the direction of lines 2—2.

Looking at FIGS. 1 and 2, it can be seen that a printer hammerbank 50 incorporates a framework 52. The framework 52 is preferably formed from an aluminum alloy casting although other materials can be used. The casting can be machined or formed in any suitable way so as to provide for the support function for the operation of the hammersprings placed along the hammerbank 50.

In conjunction with the framework 52 a series of fins 54 are provided. Fins 54 provide heat dissipation as a respective heat sink enhancing operation.

The pole pieces that conduct the permanent magnetism are seen as magnetic poles or pole pieces 56 and 58. The magnetic poles or pole pieces 56 and 58 are divided by a magnetic insulator and contacting wear bar 60 made preferably of Inconel 718 nickel alloy.

Each pole piece 56 and 58 is placed in alignment within the framework 52 so as to provide for a plurality of pairs of pole pieces 56 and 58. Each pair of pole pieces 56 and 58 magnetically retains and then releases a hammerspring or print hammer 64.

The pole pieces 56 and 58 are preferably formed of alloy steel so that they can establish magnetism at the tips of the pole pieces 56 and 58. This magnetism holds the hammersprings 64 in close but not necessarily contacting juxtaposition to the pole pieces 56 and 58 against the wear bar 60 until they are released by electrical flow through coils 66 and 67 overcoming the permanent magnetic forces.

The release of the hammersprings 64 can be by any electrical force placed in juxtaposition to the pole pieces 56 and 58 to nullify their permanent magnetism for a brief instant. This is accomplished by connection to a current or voltage source not shown.

The hammersprings 64 are formed in frets having a plurality of hammersprings, for example four or more in number. One of these frets is shown as fragmented fret 68 having four hammersprings 64 connected to the framework 52. This fret 68 is connected to the framework 52 by means of screws 70 threaded into tapped openings 72 in the framework 52.

Thus, a plurality of frets 68 can be attached to the framework 52 along the base thereof. This allows for a plurality of hammersprings 64 to be secured and released with respect to the magnetic action of the pole pieces 56 and 58.

The frets 68 with the hammersprings 64 are preferably ground from a single piece of spring steel alloy according to the invention.

Each hammerspring 64 is then preferably provided with a cemented tungsten carbide printing tip or rod 74, which is welded to the hammersprings, preferably by means of resistance welding. These carbide tips 74 are well known in the art for line printers and dot matrix printers and can be exemplified by numerous patents as owned by the Assignee of this invention.

A pair of magnetically conducting strips, conductors, or members 78 and 80 are mounted in the framework 52. These terminate and in part form the pole pieces 56 and 58 as the ends thereof. These magnetic conductors 78 and 80 are preferably formed initially of a highly magnetically conductive material that has been laminated from a number of sheets of magnetic material sandwiched with non magnetically conductive layers to limit any improper, spurious or eddy currents forming in their longitudinal direction.

Between the magnetically conductive elements or conductors 78 and 80 is a permanent magnet 82 which allows conduction of magnetism through the magnetically conductive conductors to provide for a magnetic force at the magnetic pole pieces 56 and 58 which are in effect the respective ends of the conductors.

Terminals 84 and 86 are connected to coils 66 and 67 which are energized by electrical current to provide for overcoming the magnetic forces at the pole pieces 56 and 58.

Figure 3:
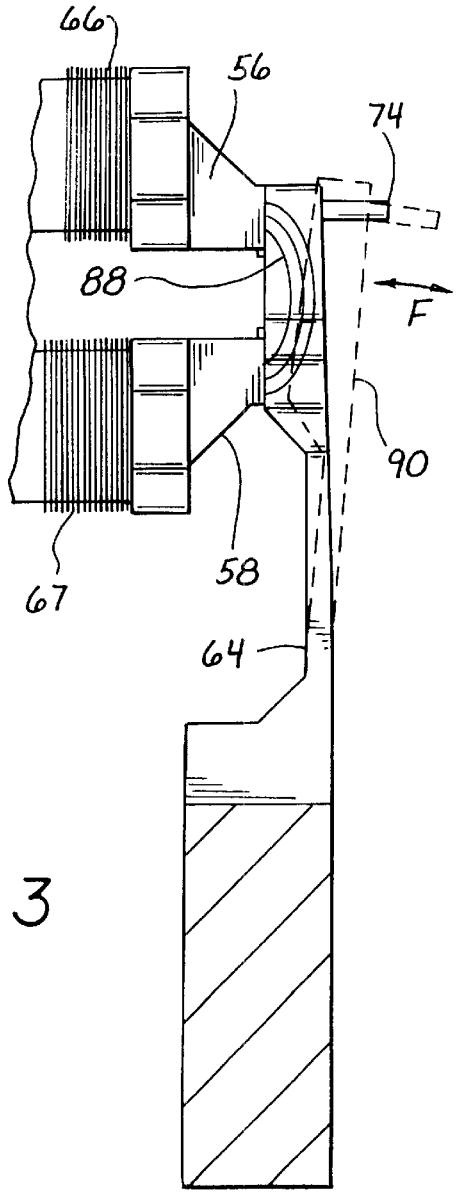
FIG. 3 shows a detailed sectional view of the hammerbank shown in FIG. 1 in the direction of lines 2—2 thereof with the hammerspring in a retracted position and a dotted overlay after it has been released or fired.

As shown in FIG. 3, the lines 88 between the pole pieces 56 and 58 indicate the magnetic field. When the permanent magnetism is overcome at the pole pieces 56 and 58, the hammersprings 64 are released. This causes them to fire toward the right hand side as shown. Retention and release movement is in the direction of double-sided arrow F. The dotted configuration shown by the dotted outline 90 shows the movement of the hammerspring 64 going over dead center.

The printer hammerbank and hammersprings described above are those of the Assignee of this invention. A fuller description of dot matrix printers and hammerbanks of hammersprings can be found in U.S. Pat. No. 5,335,999, the whole of which is incorporated herein by reference.

Other types of hammersprings and hammerbanks are known in the art and any particular type of printer in which the hammersprings and hammerbanks of the invention are employed does not limit the invention.

HIGH MAGNETIC STRENGTH SPRING STEEL ALLOYS

The novel steel alloys of the invention having high magnetic saturation induction are formed of iron, cobalt, and nickel alloys or spring steels comprising in percent by weight: about 20% to about 35% Co; about 2% to about 6% Ni; 0% to about 0.15% C; about 0.75% to about 3% Mo; 0% to about 3% Cr; 0% to about 2% Mn; 0% to about 0.02% Si; 0% to about 0.003% P; 0% to about 0.001% S; 0% to about 0.005% $O_2$+$N_2$; with the balance comprised of Fe. Trace elements and Impurities including among others, W, V, Nb Si, P, $O_2$+$N_2$ should be kept as low as possible, preferably less than a combined total amount by weight of about 1%.

Preferably the alloys of the invention comprise in percent by weight between; about 23% to about 29% Co; about 2% to about 6% Ni; 0% to about 0.15% C; about 0.75% to about 3% Mo; 0.50% to about 2.0% Cr; 0% to about 0.05% Mn; 0% to about 0.02% Si; 0% to about 0.003% P; 0% to about 0.001% S; 0% to about 0.005% $O_2$+$N_2$; with the balance comprised of Fe.

The addition of hardening alloy elements into a Fe—Co—Ni alloy decreases the saturation induction due to the simple solution dilution law, but it increases the mechanical strength of tile alloy. Using the Mo, Cr, W, V, Nb or its combination along with the carbon can promote the hardening mechanisms of the age hardening steels. Since the magnetic saturation is the main concern of this invention, addition of these alloy elements should be minimized so as not to significantly sacrifice the total saturation magnetization. Preferably the total combined amount of Mo, Cr, W, V, and Nb, does not exceed about 5% by weight.

Heat treatment is very important to the final properties of the steels. The homogenization temperature of the slab, the rolling temperature, the solution treatment temperature, the cooling rate, the ageing temperature and the duration of ageing, all may affect the alloy microstructures and influence the saturation induction and mechanical strength.

THE PROCESS STEPS OF THE INVENTION

Melting

According to the preferred process, the virgin constituent materials arc mixed together and melted using standard procedures. Preferably the virgin raw materials have <0.05% total combined impurity level of such elements as S, P, $O_2$, $N_2$, Si, W, V, and Nb.

The primary melting process is conducted in a vacuum or other protective atmospheric conditions, and an optional secondary refining process can be provided for the removal of gas contents and other impurities, such as oxides, nitrides and sulfides. Preferably the master heat is made by a vacuum induction melting (VIM) process, and the optional secondary refining is preferably made by a vacuum arc remelting (VAR) process although other refining processes may be used.

The melt is cast into an ingot. After removing any surface oxidation layer, the cast ingot can be broken down or forged into slabs or billets using a conventional breakdown mill or rotary press and then cooled to room temperature. Preferably, the slabs or billets are coated with an oxidation resistant coating; such as a glass or silicate grit type coating, before the homogenization process to prevent surface oxidation during the process.

Homogenization

The slab or billet is homogenized by heating to a temperature of about 400° F. to about 500° F. lower than the melting point of the alloy, in a gas-fired or electrical furnace.

The exact temperature and time will depend on the composition of the alloy but the temperature used is generallysufficient to remove the casting segregation. Excellentresults have been obtained in this invention by using a homogenization temperature of 2150° F. ±500° F. for 24 hours.

Table 1 shown below gives examples of the preferred alloys with their preferred minimum and maximum, and actual measured concentrations of each constituent element in percent by weight.

TABLE 1

| Alloy Chemistry | | C | Mn | Si | P | S | Cr | Ni | Co | Mo | $O_2 + N_2$ | Fe |
|---|---|---|---|---|---|---|---|---|---|---|---|---|
| Example 1 | Min. | 0.13 | — | — | — | — | 0.90 | 4.50 | 25.00 | 1.90 | — | Bal. |
| | Max. | 0.15 | 0.05 | 0.02 | 0.003 | 0.001 | 1.10 | 5.50 | 26.00 | 2.10 | 0.005 | — |
| | Actual | 0.131 | 0.005 | <0.02 | <0.003 | <0.001 | 0.98 | 5.04 | 25.27 | 1.95 | <0.003 | Bal. |
| Example 2 | Min. | 0.04 | — | — | — | — | 0.90 | 4.50 | 25.00 | 1.90 | — | Bal. |
| | Max. | 0.10 | 0.05 | 0.02 | 0.003 | 0.001 | 1.10 | 5.50 | 26.00 | 2.10 | 0.005 | — |
| | Actual | 0.063 | 0.02 | 0.01 | 0.003 | <0.001 | 0.99 | 4.97 | 25.60 | 2.11 | <0.003 | Bal. |
| Example 3 | Min. | 0.01 | — | — | — | — | 1.20 | 4.50 | 25.00 | 1.00 | — | Bal. |
| | Max. | 0.03 | 0.05 | 0.02 | 0.003 | 0.001 | 1.40 | 5.50 | 26.00 | 1.20 | 0.005 | — |
| | Actual | 0.014 | 0.01 | 0.01 | <0.01 | <0.001 | 1.33 | 4.90 | 25.50 | 1.17 | <0.003 | Bal. |

Rolling

After homogenization, the surface of the billet or slab is surface ground, sand blasted or acid pickled to remove all surface oxides and defects. It is then hot rolled to plate form under ambient atmospheric conditions using standard hot rolling processes. The exact rolling temperature depends on the constituents making up the alloy. Excellent results have been obtained for the alloys of the invention with a beginning rolling temperature in the range of about 2000° F. to about 2200° F. and a finishing rolling temperature of at least about 1600° F. when the specific desired thickness is achieved. This step can be followed by finish rolling such as cold rolling, if desired, and provided with additional solution heat treatment. At this point, the rolled steel alloy can be cut to the final size.

Solution Treating, Quenching and Sub-Zero Treatment

Subsequent heat treatment includes solution treating at a temperature in the range of about 1500° F. to about 1700° F. for a minimum of one hour per half inch under a vacuum or inert gas protective atmosphere. Again, the exact time and temperature will depend upon the particular constituents of the alloy and upon the thickness. These steps are followed by a cooling process, for example, in a re-circulating inert gas environment or in still air, from the solution temperature to below 300° F., preferably within about 30 minutes. After reaching room temperature, the steel alloys are immersed in a sub-zero bath to eliminate any possible retained austenite. The recommended process for the sub-zero treatment is to soak the steel alloy to a temperature below −100° F. for about one hour per half inch.

Aging Treatment

The steel is then warmed in air to room temperature. The alloy is precipitation aged at a temperature in the range of about 800° F. to about 1100° F. for 6 hours or longer. The best results have been obtained with periods of about 8 to36 hours. The optimum temperature and time depends upon the specific alloy constituents.

EXAMPLES

Chemistry

The alloy slab was melted using 100% virgin raw materials in a lab-scale vacuum induction-melting furnace. The slab was then processed as per the above described processing procedures to convert into plate form. The chemical analysis was performed at ingot level.

Mechanical Properties and Magnetic Saturation Induction Measurements

The desired properties for use as a print hammer include: a minimum tensile strength of 170,000 psi; a minimum yield point of 130,000 psi, a minimum elongation (2 inch sample) of 5%, a minimum hardness of 36 HRC; and a minimum Bmax at 560 Oersteads of 21.8 KG.

For each alloy sample listed in Table 1, the solution time and temperature, and aging time and temperature were varied followed by testing of the properties of that alloy sample.

The specific processing conditions and the resulting properties for each of the alloy samples are detailed in Tables 2–4. Hardness, tensile and yield strengths, and elongation were measured using ASTM standard A 370 method. All test results shown in the Tables 2–4 are the average results of a test group of three specimens minimum. B/H measurements were conducted in conformance with the requirements of ASTM standard A 596. Fatigue testing was conducted as per the general guidelines listed in ASTM standard E 466.

Example 1

Samples of the alloy of Example 1 were solution heat treated at 1530° F., 1610° F. and 1650° F. As found from the microstructural analysis results, the solution temperature used above 1610° F. produced martensitic microstructure after air-cooling to room temperature.

Figure 4:
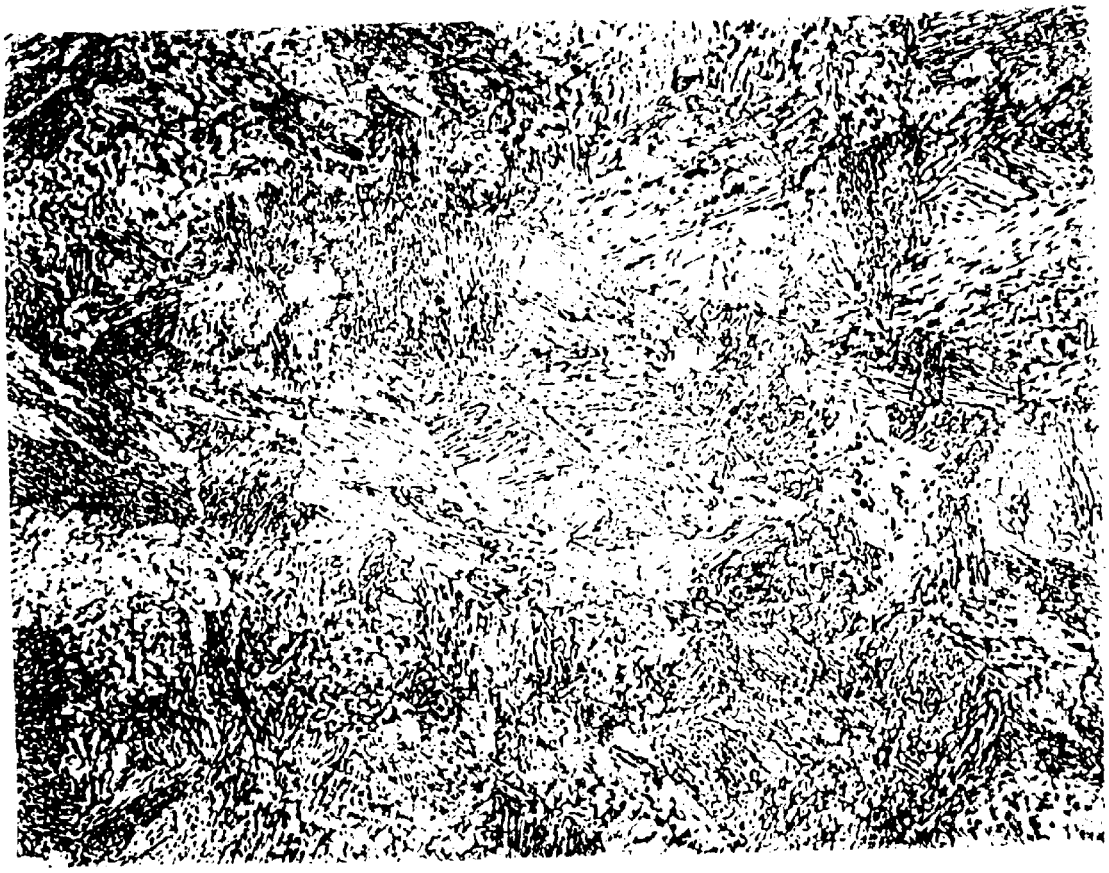

Mixed lamellar microstructures were formed under conditions in which the solution treatment temperature was lower than 1610° F. Samples having this type of microstructure had lower hardness than samples having the martensitic microstructure. Typical lamellar microstructure of an Alloy of Example 1 is shown in FIG. 4.

Various ageing temperatures were used to study the kinetics of precipitation reactions. The criteria of determination of the ageing temperatures were the combination of alloy magnetic properties, tensile and yield strengths and fatigue strength. As indicated in Table 2 below, the improvement of magnetic properties was directly proportionate to the time of ageing precipitation. However, the tensile and yield strengths decreased with the extensive ageing time used for the process.

TABLE 2

| Alloy Type | Solution Temperature (° F.) | Ageing Temp. (° F.) | Ageing Time (Hour) | Hardness HRC | Bmax (at 400 Oe) | Bmax (at 560 Oe) | Tensile Strength (psi) | Yield Strength (psi) | Elongation (%) |
|---|---|---|---|---|---|---|---|---|---|
| Example 1-1 | As-Rec. | | | 45.2 | 17 | | | | |
| Example 1-2 | 1530 ± 10 | | | 39.5 | 17.8 | 19.5 | | | |
| Example 1-3 | 1530 ± 10 | 870 ± 10 | 6 | 44.8 | 19.8 | 21.1 | | | |
| Example 1-4 | 1530 ± 10 | 870 ± 10 | 21 | 45.5 | 20.4 | 21.8 | | | |
| Example 1-5 | 1530 ± 10 | 870 ± 10 | 88 | 43.3 | 21.4 | 22.3 | | | |
| Example 1-6 | 1530 ± 10 | 920 ± 10 | 6 | 47.3 | 19.5 | 21.2 | | | |
| Example 1-7 | 1530 ± 10 | 920 ± 10 | 14 | 47.1 | | | | | |
| Example 1-8 | 1530 ± 10 | 920 ± 10 | 28 | 45.0 | 21.4 | 22.2 | | | |
| Example 1-9 | 1530 ± 10 | 970 ± 10 | 6 | 42.0 | 20.8 | 21.8 | | | |
| Example 1-10 | 1610 ± 10 | | | | | | 208750 | 167083 | 16.6 |
| Example 1-11 | 1610 ± 10 | 950 ± 10 | 5 | | | | 234000 | 227000 | Brittle |
| Example 1-12 | 1610 ± 10 | 950 ± 10 | 14 | | 20.4 | 21.7 | 241000 | 219000 | 9.9 |
| Example 1-13 | 1610 ± 10 | 950 ± 10 | 24 | | 21.2 | 22.7 | | | |
| Example 1-14 | 1610 ± 10 | 950 ± 10 | 36 | | 21.4 | 22.6 | 229200 | 220800 | 10.6 |
| Example 1-15 | 1610 ± 10 | 970 ± 10 | 6 | | 20.5 | 21.9 | | | |
| Example 1-16 | 1610 ± 10 | 970 ± 10 | 24 | 46.8 | 21.4 | 22.4 | 239000 | 215000 | 10.7 |
| Example 1-17 | 1610 ± 10 | 990 ± 10 | 6 | 43.4 | 20.4 | 22.2 | 215000 | 188000 | 11.0 |
| Example 1-18 | 1650 ± 10 | 970 ± 10 | 6 | 53.6 | 19 | 21 | | | Brittle |
| Example 1-19 | 1650 ± 10 | 990 ± 10 | 6 | 52.0 | 19.4 | 21.3 | | | Brittle |
| Example 1-20 | 1650 ± 10 | 990 ± 10 | 24 | 49.5 | 20.9 | 22.3 | | | Brittle |
| Example 1-21 | 1650 ± 10 | 990 ± 10 | 48 | 46.0 | | | | | |
| Example 1-22 | 1650 ± 10 | 1000 ± 10 | 6 | 50.7 | 19.5 | 21.3 | | | |

Evidently, as shown in Table 2, slightly over-ageing helped to improve magnetic properties. However, when the sample was aged longer than the optimal duration, the mechanical properties were adversely affected. Example 1-17, which was aged at 990° F. for 6 hours is a typical example of losing both tensile and yield strengths with only 6 hours of ageing. Martensitic microstructure was formed after the sample was cooled down from a solution temperature above 1610° F. Metal carbide precipitates started to form during the ageing treatments.

Figure 5:
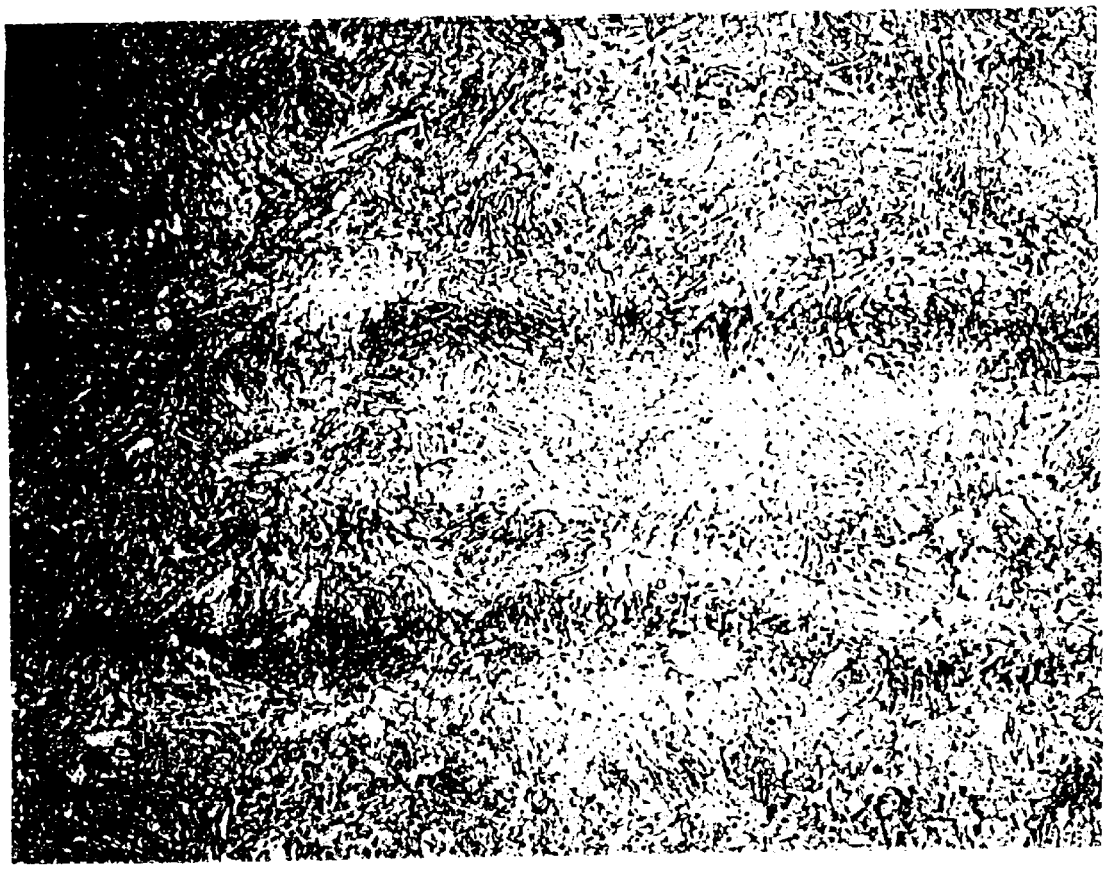
Figure 6:
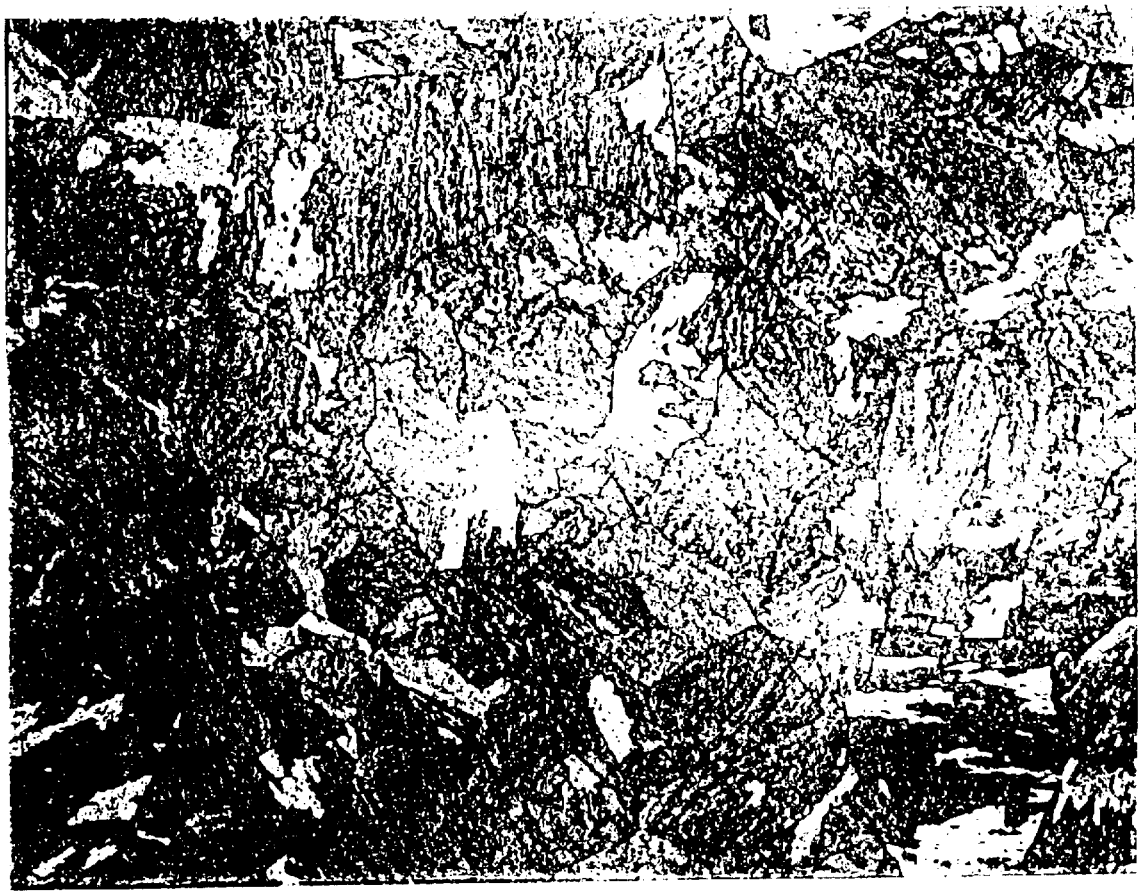
Figure 7:
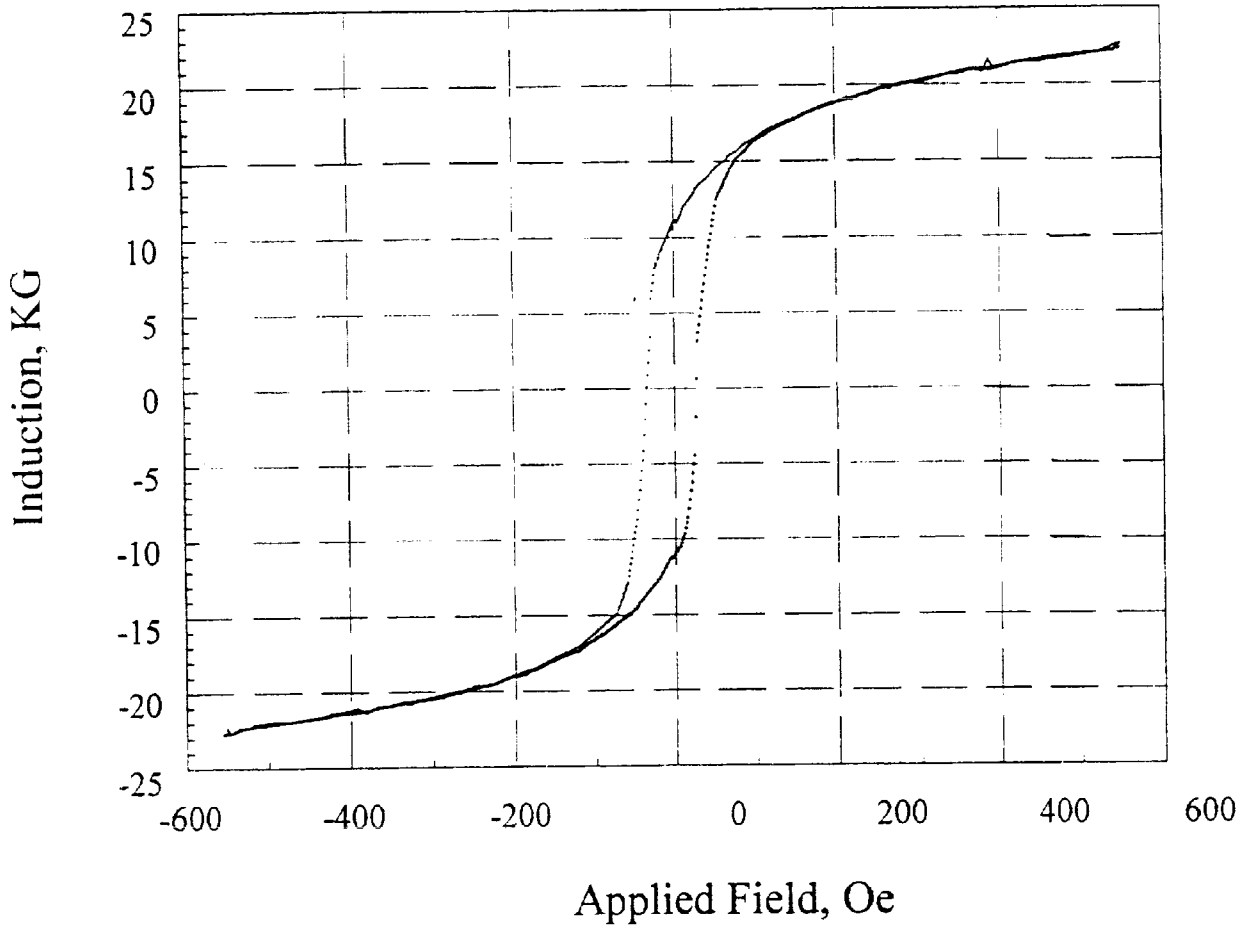
Figure 8:
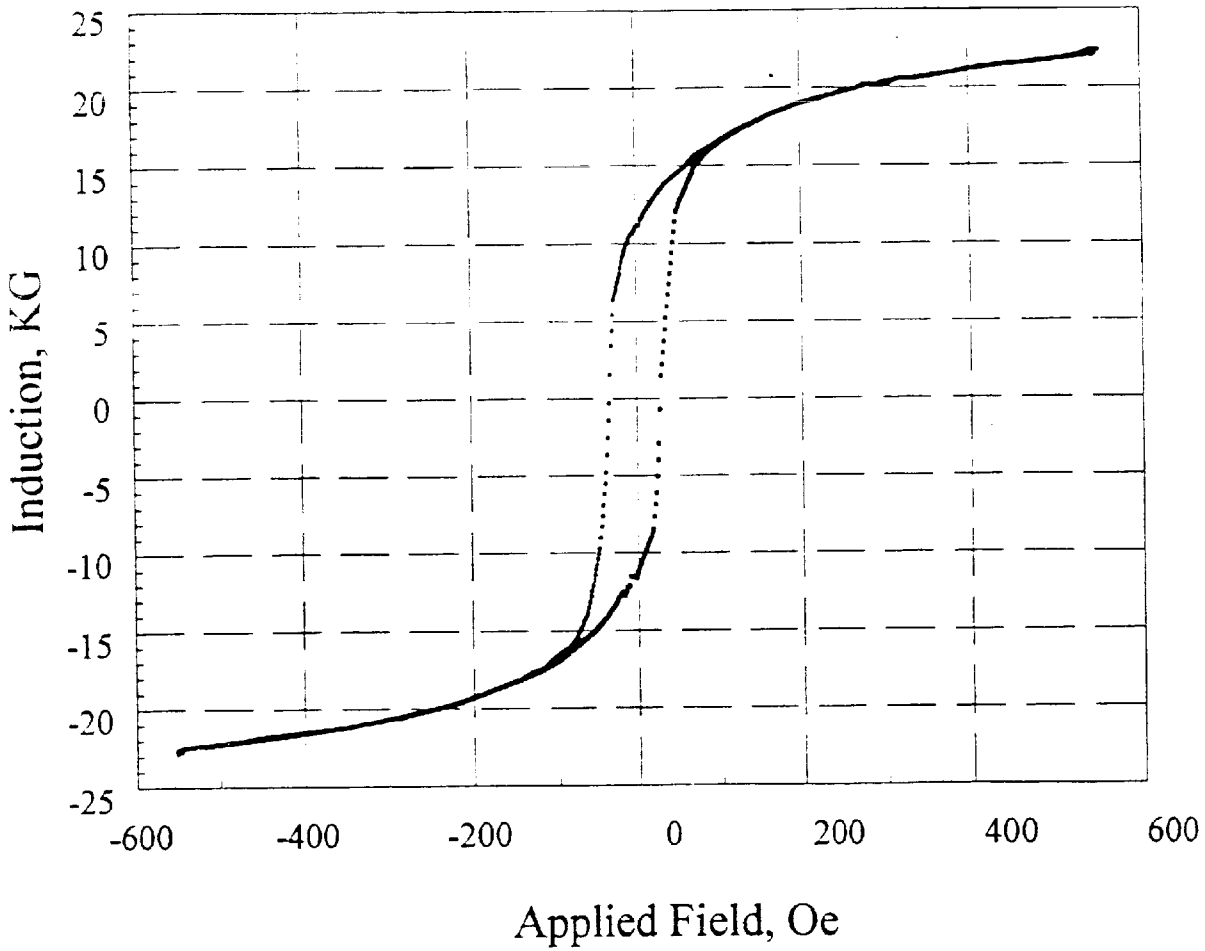

Typical martensitic microstructure embedded with carbide precipitates of Sample 1-14 is shown in FIG. 5. Higher solution treatment temperatures promoted the size of the pre-austenitic grains, which induced the brittleness of the alloy. Alloy examples 1-18 to 1-20, which were solution treated at 1650° F. and aged at a temperature up to 990° F. and up to 24 hours of duration, exhibited brittleness although they had higher hardness. FIG. 6 shows typical microstructure of Sample 1-20. FIGS. 7 and 8 show typical magnetic hysteresis loops (B/H curves) of Examples 1-13 and 1-14 respectively.

The highest tensile and yield strengths combined with good elongation were obtained when samples were solution heat treated at 1610° F., air cooled and then aged in between 950° F. to 970° F. for 14 to 36 hours. However, the best magnetic saturation induction values were obtained when the ageing duration was greater than 14 hours. Alloy Examples 1-14 and 1-16 gave the best combinations of the mechanical strength and magnetic properties. Other than the solution heat treating temperatures, the duration of ageing treatment was the predominate factor for determining the saturation induction values. The microstructure shown in FIG. 4 is a typical example of the Sample 1-5.

Figure 9:
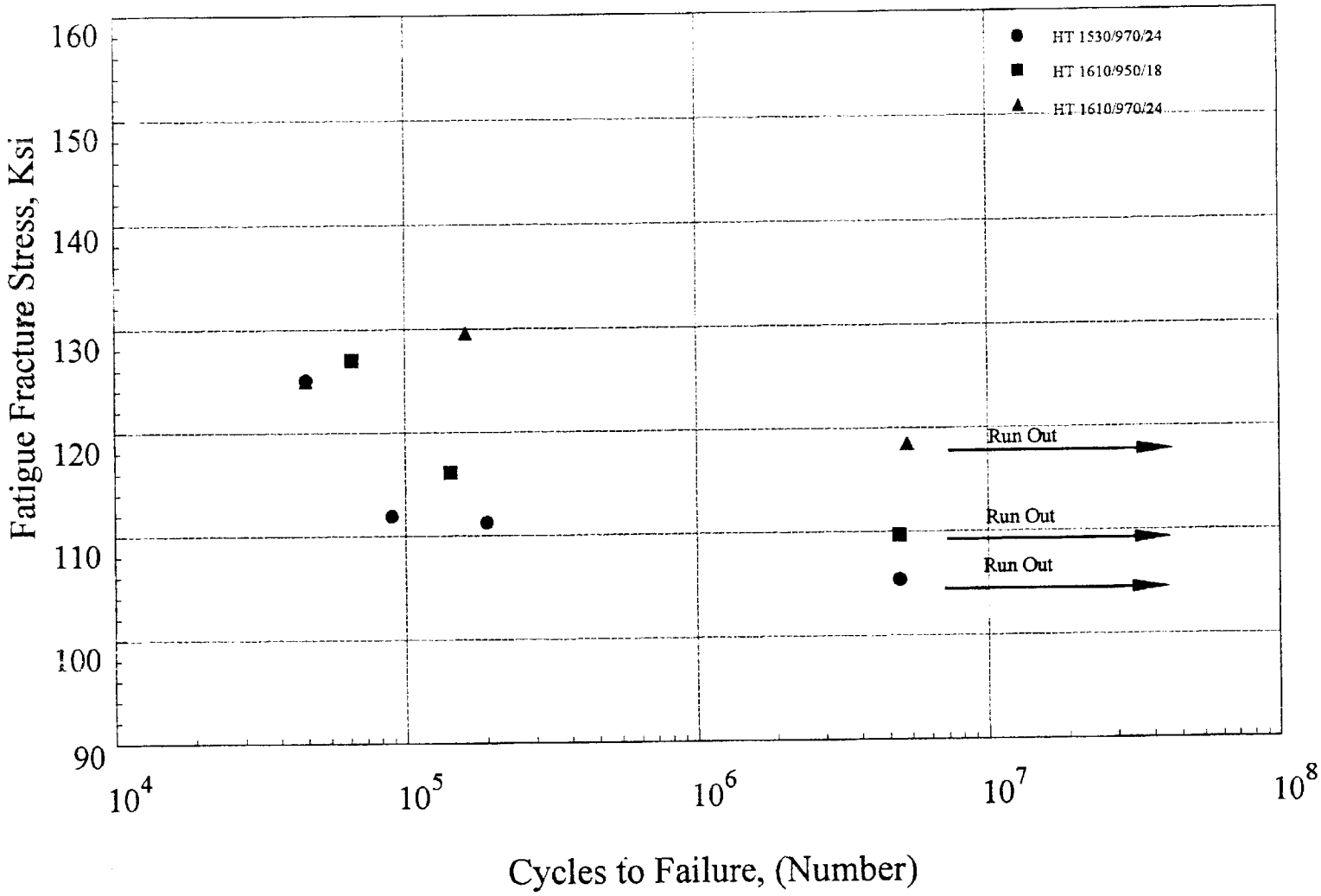

FIG. 9 shows the fatigue fracture stress plotted against the number of cycles to failure (fatigue S/N plot). As a general correlation, the specimens having higher tensile strength had better fatigue strength. Alloy Example 1-16 had a fatigue limit approaching 120 ksi, which is in the typical range of most ultra high strength steels.

In summary, the Alloys of Example 1, after proper solution heat treatment and ageing precipitation, had tensile strengths exceeding 220 ksi and yield strengths exceeding 210 ksi, a fatigue limit exceeding 115 ksi, and a magnetic saturation induction exceeding 22.4 KG. However, due to high carbon concentration of this particular formulation, carbides precipitated in the matrix were excessive. Although those carbides did not cause the deterioration of the tensile properties of the alloy if adequate heat treatment was conducted, it was more desirable to lower the carbon concentration to reduce the total concentration of carbide precipitation.

Example 2

Samples of the Alloy of Example 2 were solution heat treated at 1570° F., 1620° F. and 1670° F. Test results of this type of alloy are shown in Table 3 below.

TABLE 3

| Alloy Type | Solution Temperature (° F.) | Ageing Temp. (° F.) | Ageing Time (Hour) | Hardness HRC | Bmax (at 400 Oe) | Bmax (at 560 Oe) | Tensile Strength (psi) | Yield Strength (psi) | Elongation (%) |
|---|---|---|---|---|---|---|---|---|---|
| Example 2-1 | As-Received | | | 42.5 | 17.4 | | | | |
| Example 2-2 | 1570 ± 10 | | | 38.3 | 18.6 | | | | |
| Example 2-3 | 1570 ± 10 | 915 ± 10 | 16 | 43.5 | 20.2 | 21.2 | | | |
| Example 2-4 | 1570 ± 10 | 965 ± 10 | 16 | 43.0 | | | | | |
| Example 2-5 | 1570 ± 10 | 1015 ± 10 | 8 | | 21 | 22.1 | 227000 | 216000 | 11.0 |
| Example 2-6 | 1570 ± 10 | 1015 ± 10 | 16 | 43.2 | 21.1 | 22 | 185000 | 152000 | 16.0 |

TABLE 3-continued

| Alloy Type | Solution Temperature (° F.) | Ageing Temp. (° F.) | Ageing Time (Hour) | Hardness HRC | Bmax (at 400 Oe) | Bmax (at 560 Oe) | Tensile Strength (psi) | Yield Strength (psi) | Elongation (%) |
|---|---|---|---|---|---|---|---|---|---|
| Example 2-7 | 1570 ± 10 | 1015 ± 10 | 32 | 40.0 | 21.2 | 22.1 | | | |
| Example 2-8 | 1570 ± 10 | 1015 ± 10 | 48 | | 21.2 | 22.1 | | | |
| Example 2-9 | 1620 ± 10 | | | 42.0 | 17.3 | 19 | | | |
| Example 2-10 | 1620 ± 10 | 915 ± 10 | 16 | 51.0 | | | | | |
| Example 2-11 | 1620 ± 10 | 965 ± 10 | 16 | 49.0 | | | | | |
| Example 2-12 | 1620 ± 10 | 1015 ± 10 | 16 | 50.5 | 20.5 | 21.9 | 227000 | 227000 | Brittle |
| Example 2-13 | 1620 ± 10 | 1015 ± 10 | 36 | | 20.5 | 21.9 | | | |
| Example 2-14 | 1670 ± 10 | | | 41.5 | | | | | |
| Example 2-15 | 1670 ± 10 | 915 ± 10 | 16 | 50.0 | 18 | 19.5 | | | |
| Example 2-16 | 1670 ± 10 | 965 ± 10 | 16 | 51.0 | | | | | |
| Example 2-17 | 1670 ± 10 | 1015 ± 10 | 8 | | | | 227000 | 212500 | Brittle |
| Example 2-18 | 1670 ± 10 | 1015 ± 10 | 16 | 50.5 | 20.5 | 21.7 | 214000 | 214000 | Brittle |
| Example 2-19 | 1670 ± 10 | 1015 ± 10 | 32 | 45.1 | 20.9 | 22.1 | | | |
| Example 2-20 | 1670 ± 10 | 1015 ± 10 | 48 | | 21.1 | 22.1 | | | |

As found from the microstructural analysis results, a solution temperature above 162001produced martensitic microstructure after being air-cooled to room temperature. However, the microstructures of those samples that were heat treated at 1570° F. showed mainly mixed lamellar phases. When comparing the obtained hardness, it was found that samples showing fully martensitic microstructure had higher hardness numbers than those samples showing the lamellar phases. However, samples with the martensitic microstructure were brittle in nature even after lengthy ageing treatment. Various ageing temperatures were used to study the kinetics of precipitation reactions. The criteria of optimizing the process parameters, such as solution treatment and the ageing temperatures, were based on the results of the alloy magnetic properties, tensile and yield strengths and fatigue strength.

When compared with samples of the Alloy of Example 1, the decreased carbon concentration of this alloy helped to reach the optimal ageing condition in a relatively shorter duration. The combination of the overall tensile properties were best obtained when the samples were solution heat-treated at 1570° F., air cooled and then aged at 1015° F. for 8 hours (Sample 2-5). The resulting magnetic saturation induction values of Samples 2-5 and 2-6 were greater than or equal to 22 KG. The resulting tensile properties of Sample 2-5 were greater than 220 psi with more than 10% elongation.

Figure 10:
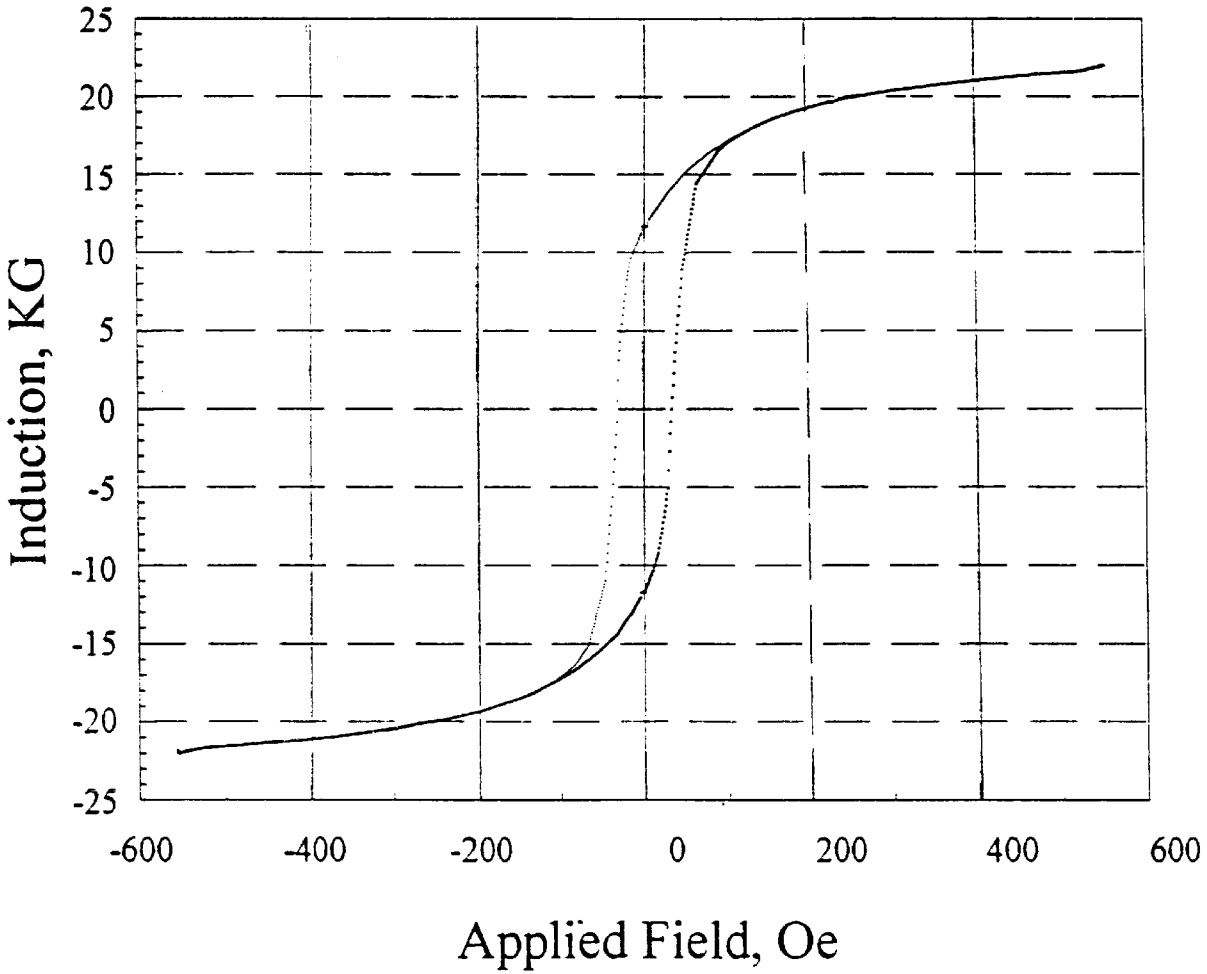
Figure 11:
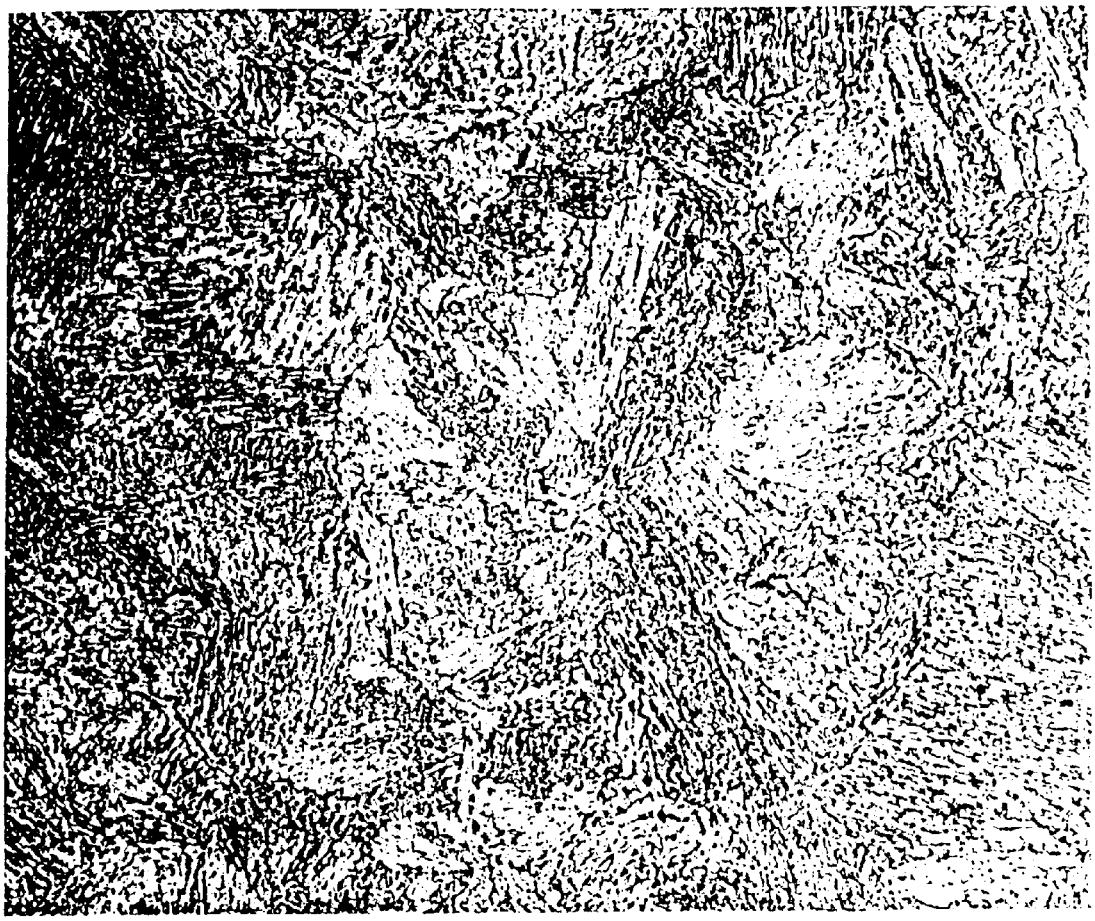
Figure 12:
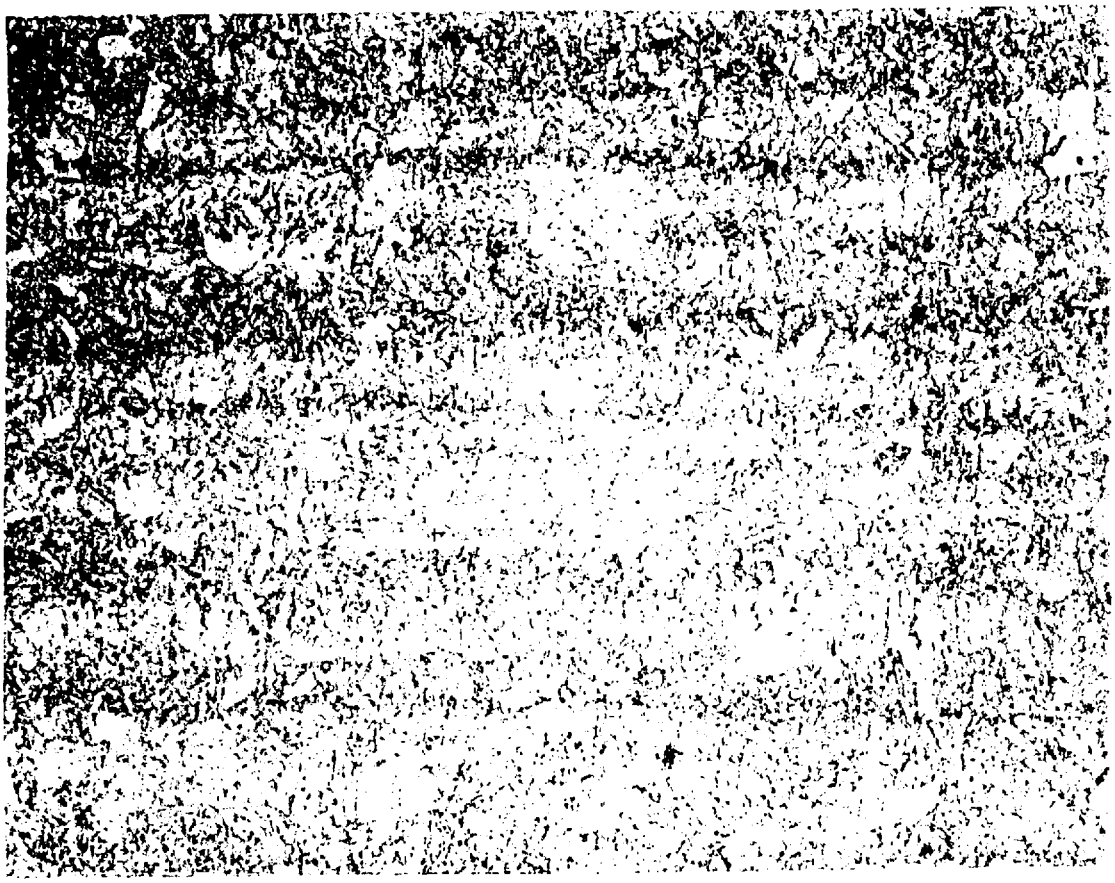
Figure 13:
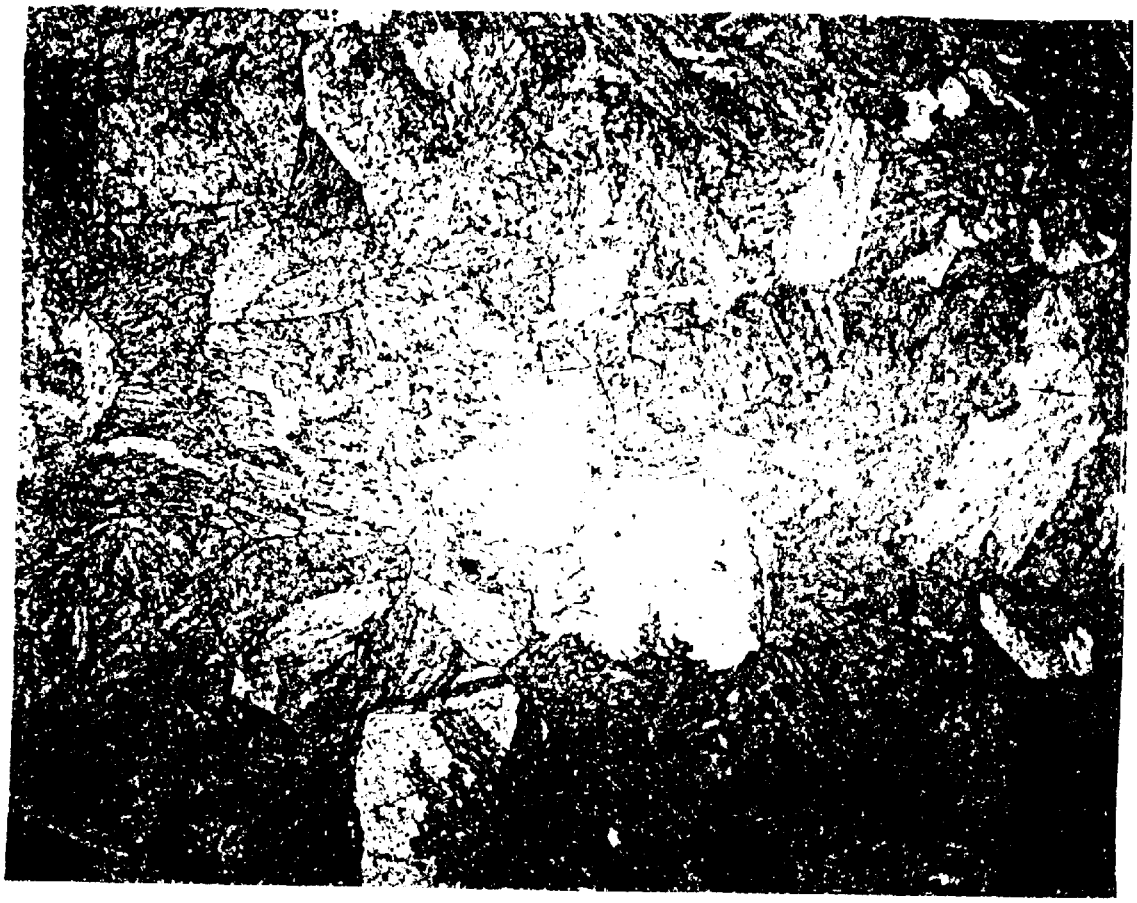

The typical B/H curve of Sample 2-6 is shown in FIG. 10. Samples with martensitic microstructure had higher hardness numbers. However, these samples had inherent tensile brittleness and an elongation that was less than 2%. FIG. 11 shows the typical lamellar microstructures of Sample 2-5, and FIGS. 12 and 13 show the typical martensitic microstructures of Samples 2-12 and 2-18.

Evidently, over-ageing was not an effective method to improve the magnetic saturation of this alloy. This was especially true for those samples with the lamellar microstructures. Lengthy ageing treatment, up to 48 hours did not drastically change the saturation induction values of this type of alloy. However, the longer ageing duration did adversely affect the hardness as well as the tensile properties. The significant reductions of the tensile strength coupled with the increase of the elongation of the Sample 2-6 are a typical example of this case.

Figure 14:
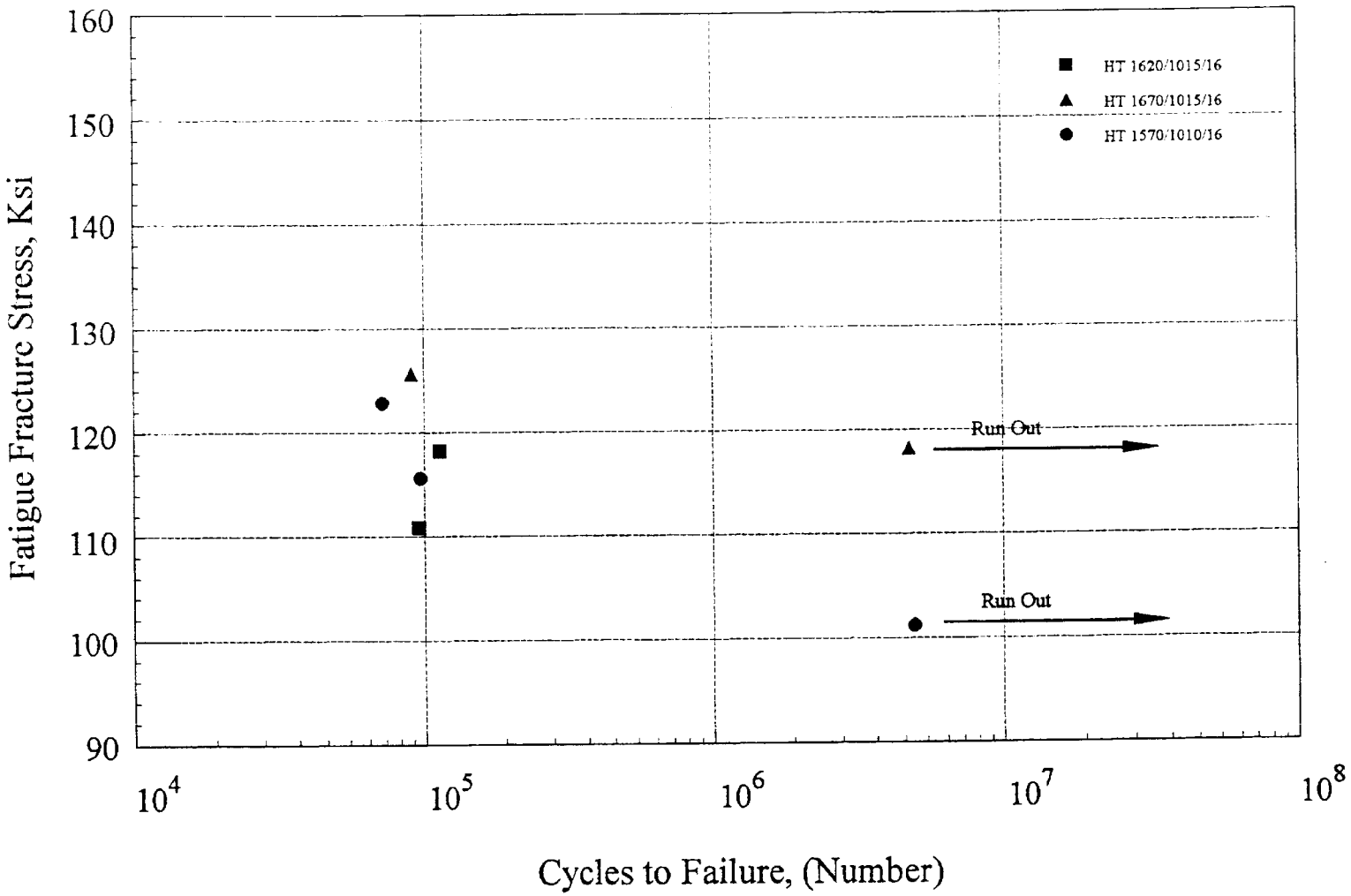

The fatigue S/N plot of this alloy is shown in FIG. 14. Again, as a general correlation, specimens having a higher tensile strength had better fatigue strength. Sample 2-12 with martensitic microstructure had a fatigue limit of about 120 ksi, which is in the same range as that Alloy Example 1. Samples with lamellar microstructures that were aged at 1015 F. for 16 hours had a fatigue limit of approximately 100 ksi. This was also in a similar range as that of the is Alloy of Example 1 with the lamellar microstructures. This plus the tensile test data indicated that the reduction of the carbon concentration from 0.13% to 0.06% did not alter the final mechanical properties of this type of alloy.

In summary, samples of the Alloy of Example 2 with proper solution heat treatment and ageing precipitation, had tensile strengths exceeding 220 ksi and yield strengths exceeding 210 ksi, fatigue limits exceeding 115 ksi, and a magnetic saturation induction exceeding 22 KG. In addition, this alloy, even at an over-aged condition, had minimum fatigue limits of 100 ksi.

Example 3

The effect of the reduction of carbon to a minimum range of 0.01 % on this type of alloy, the Alloy of Example 3, was further investigated in order to obtain an alloy with less notch sensitivity and less brittleness.

Samples of the Alloy of Example 3 were solution heat treated at 1500° F. 1550° F., 1600° F. and 1650° F. Test results of this type of alloy are shown in Table 4 below.

TABLE 4

| Alloy Type | Solution Temperature (° F.) | Ageing Temp. (° F.) | Ageing Time (Hour) | Hardness HRC | Bmax (at 400 Oe) | Bmax (at 560 Oe) | Tensile Strength (psi) | Yield Strength (psi) | Elongation (%) |
|---|---|---|---|---|---|---|---|---|---|
| Example 3-1 | As-Received | | | 36.6 | | | | | |
| Example 3-2 | 1500 ± 10 | | | 33.2 | | | | | |
| Example 3-3 | 1500 ± 10 | 900 ± 10 | 8 | 41.3 | | | | | |
| Example 3-4 | 1500 ± 10 | 950 ± 10 | 8 | 39.4 | | | | | |

TABLE 4-continued

| Alloy Type | Solution Temperature (° F.) | Ageing Temp. (° F.) | Ageing Time (Hour) | Hardness HRC | Bmax (at 400 Oe) | Bmax (at 560 Oe) | Tensile Strength (psi) | Yield Strength (psi) | Elongation (%) |
|---|---|---|---|---|---|---|---|---|---|
| Example 3-5 | 1500 ± 10 | 975 ± 10 | 8 | 38.1 | | | | | |
| Example 3-6 | 1500 ± 10 | 1000 ± 10 | 14 | 38.3 | | | | | |
| Example 3-7 | 1500 ± 10 | 1050 ± 10 | 8 | 36.2 | | | | | |
| Example 3-8 | 1550 ± 10 | | | 35.2 | 19.5 | 21.2 | | | |
| Example 3-9 | 1550 ± 10 | 900 ± 10 | 8 | 35.9 | | | | | |
| Example 3-10 | 1550 ± 10 | 975 ± 10 | 8 | 39.4 | | | | | |
| Example 3-11 | 1550 ± 10 | 1000 ± 10 | 8 | 38.5 | | | | | |
| Example 3-12 | 1550 ± 10 | 1000 ± 10 | 18 | 38.8 | 21.3 | 22.0 | | | |
| Example 3-13 | 1550 ± 10 | 1000 ± 10 | 36 | | 21.3 | 22.0 | 173000 | 151000 | 18.6 |
| Example 3-14 | 1550 ± 10 | 1000 ± 10 | 48 | 38.8 | 21.3 | 22.0 | | | |
| Example 3-15 | 1550 ± 10 (SC) | | | 36.8 | 19.5 | 21.2 | (SC: Slow Cooled) | | |
| Example 3-16 | 1550 ± 10 (SC) | 1000 ± 10 | 4 | 38.2 | | | (SC: Slow Cooled) | | |
| Example 3-17 | 1550 ± 10 (SC) | 1000 ± 10 | 8 | 37.9 | 21.2 | 22.0 | (SC: Slow Cooled) | | |
| Example 3-18 | 1600 ± 10 | | | 37.2 | | | | | |
| Example 3-19 | 1600 ± 10 | 900 ± 10 | 8 | 39.4 | | | | | |
| Example 3-20 | 1600 ± 10 | 950 ± 10 | 8 | 39.6 | | | | | |
| Example 3-21 | 1600 ± 10 | 975 ± 10 | 8 | 39.4 | | | | | |
| Example 3-22 | 1600 ± 10 | 1000 ± 10 | 14 | 40.3 | 21.0 | 21.8 | | | |
| Example 3-23 | 1600 ± 10 | 1000 ± 10 | 25 | | 21.5 | 22.0 | | | |
| Example 3-24 | 1600 ± 10 | 1000 ± 10 | 36 | | 20.8 | 21.6 | | | |
| Example 3-25 | 1600 ± 10 | 1000 ± 10 | 98 | | 21.1 | 21.9 | | | |
| Example 3-26 | 1600 ± 10 | 1050 ± 10 | 8 | 39.0 | | | | | |
| Example 3-27 | 1650 ± 10 | | | 34.3 | 20.0 | 21.5 | | | |
| Example 3-28 | 1650 ± 10 | 950 ± 10 | 8 | 38.5 | | | | | |
| Example 3-29 | 1650 ± 10 | 975 ± 10 | 8 | 39.5 | | | | | |
| Example 3-30 | 1650 ± 10 | 1000 ± 10 | 14 | | 21.7 | 22.5 | | | |
| Example 3-31 | 1650 ± 10 | 1000 ± 10 | 18 | 40.2 | 21.8 | 22.5 | 188000 | 168000 | 17.0 |
| Example 3-32 | 1650 ± 10 | 1000 ± 10 | 30 | | 21.7 | 22.5 | | | |
| Example 3-33 | 1650 ± 10 | 1000 ± 10 | 36 | | 21.3 | 22.3 | 177000 | 165000 | 16.6 |
| Example 3-34 | 1650 ± 10 | 1000 ± 10 | 98 | | 21.8 | 22.5 | | | |
| Example 3-35 | 1650 ± 10 | 1050 ± 10 | 8 | 37.9 | | | | | |

As found from the microstructural analysis results, the solution temperature used above 1600° F. produced mixed martensitic microstructure after being air-cooled to room temperature. However, the microstructures of those samples that were heat treated at 1500° F. and 1570° F. were mainly mixed lamellar phases. Relatively smaller amounts of metal carbide precipitates were formed during the ageing treatments. Comparing all the obtained hardness numbers in Table 4, the samples with mixed martensitic microstructure had similar hardness numbers to those with the lamellar phases. In addition, samples with the martensitic microstructure exhibited only slightly better mechanical strengths as compared with those samples with lamellar microstructures.

Various ageing temperatures were used to study the kinetics of precipitation reactions. The criteria of optimizing the process parameters, such as solution treatment and the ageing temperatures, were mainly based on the results of the magnetic properties, tensile and yield strengths and fatigue strength.

Figure 15:
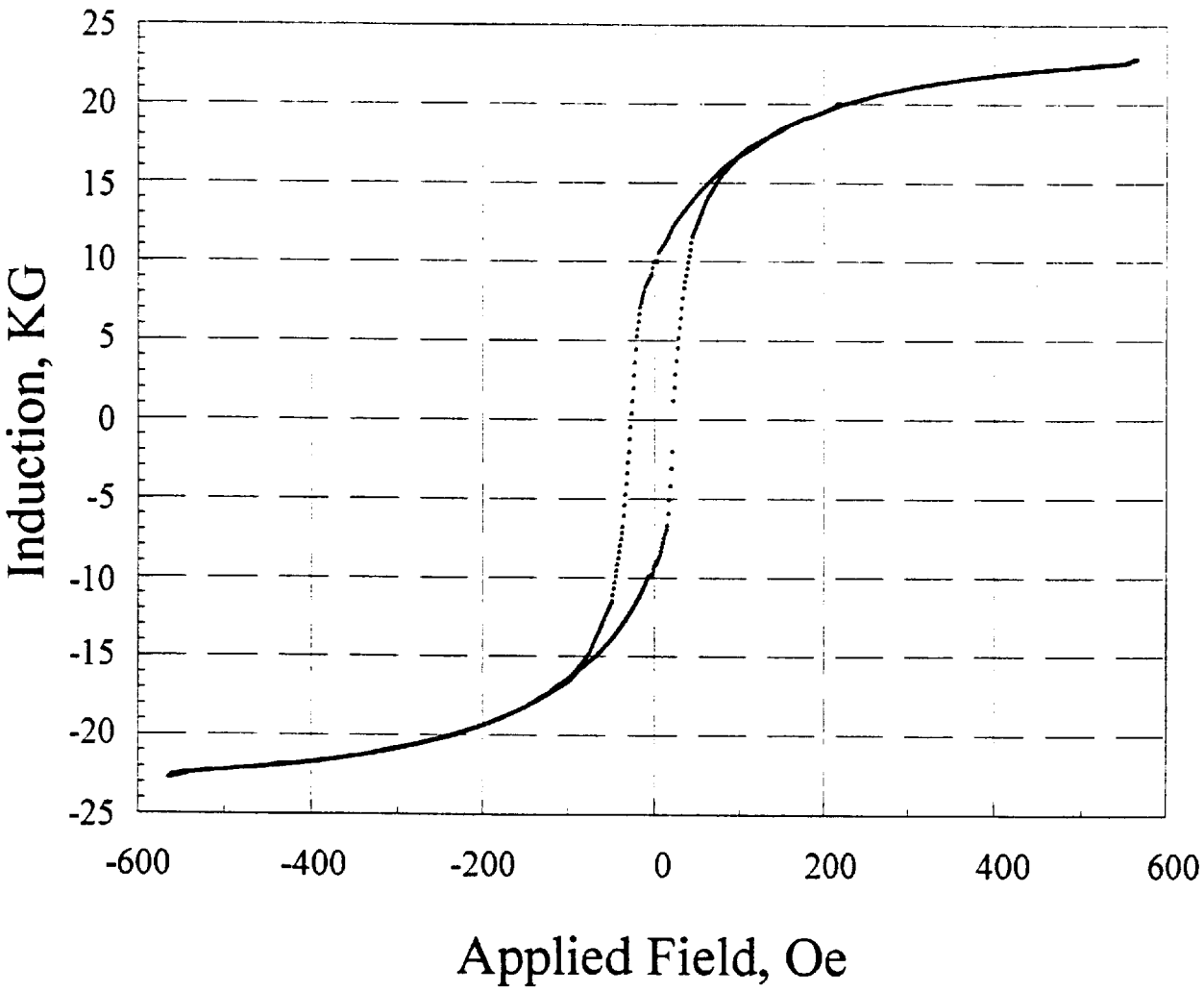

Comparing the samples of the Alloys of Examples 1 and 2 indicated that the significant decrease of the carbon concentration of this alloy reduced the resulting mechanical strength. However, the near-to-zero carbon content did not noticeably improve the final saturation induction of the alloy. The optimal magnetic properties were achieved within 18 hours of ageing. The best combination of the overall tensile properties were obtained with the samples being solution heat treated at 1650° F., air-cooled to room temperature, and then aged at 1000° F. for 18 hours (Sample 3-31). The resulting magnetic saturation induction values of the Sample 3-31 were greater than 22 KG and the resulting tensile strength was greater than 185 ksi with more than 15% elongation. The typical B/H curve of Sample 3-31 is shown in FIG. 15.

Figure 16:
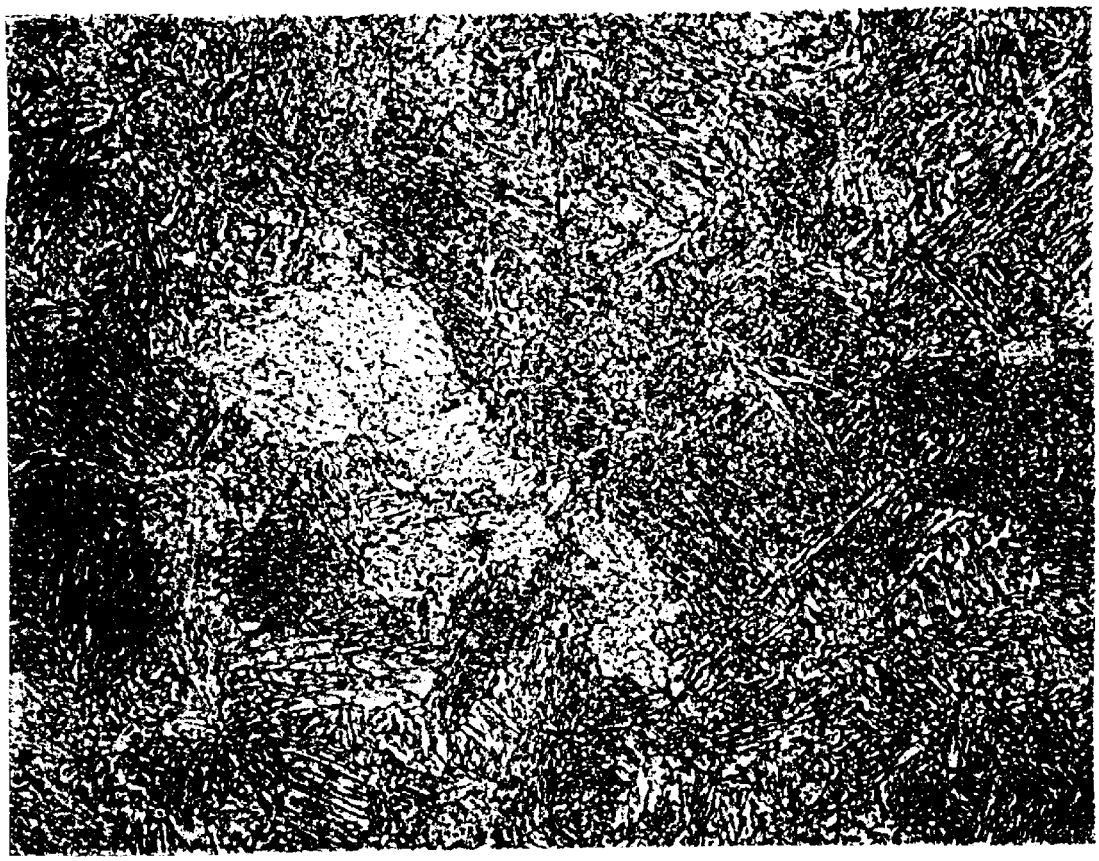
Figure 17:
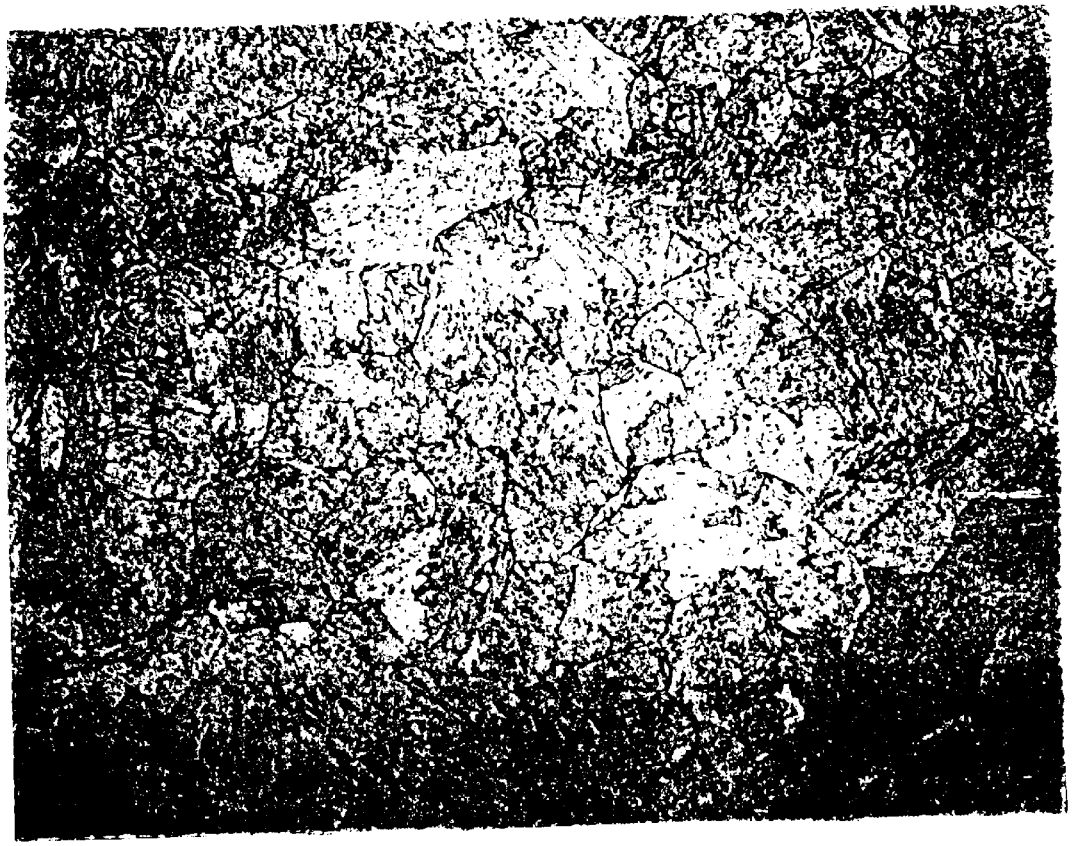
Figure 18:
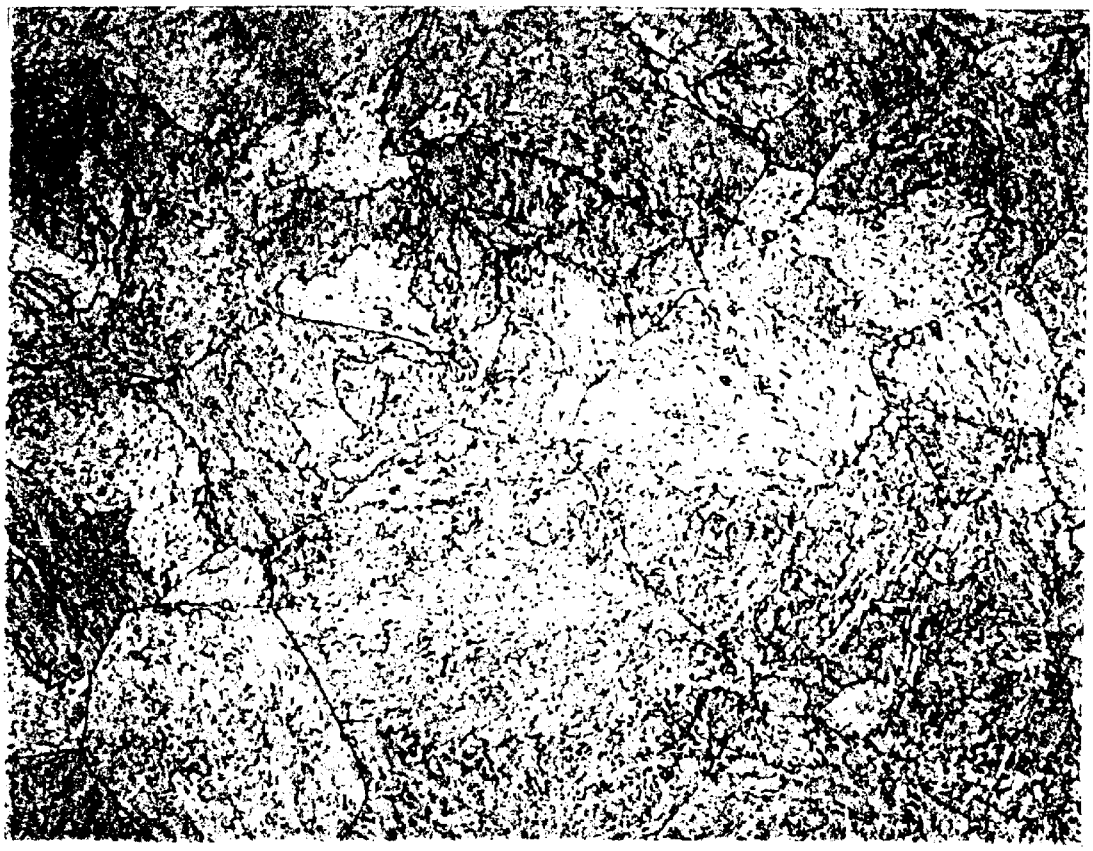

Samples with lamellar microstructures were only slightly lower in tensile strength. However, there was no obvious tensile brittleness associated with this alloy, disregarding the solution temperature used and the type of microstructures of the sample. This improvement was possibly due to the reduction of carbon concentration, which possibly reduced the total concentration of the carbides and promoted the formation of low carbon martensite. The determination of the optimal ageing temperature was thus based on the final magnetic properties. FIG. 16 shows the typical lamellar microstructures of Sample 3-12, and FIGS. 17 and 18 show the typical martensitic microstructures of Samples 3-22 and 3-35 respectively.

Over-ageing of this alloy did not provide any pronounced effects as to the final mechanical properties or to the final saturation induction. It is evident that the sample having the martensitic microstructures (Sample 3-31) had slightly better tensile and yield strengths than those having the lamellar microstructure (Sample 3-33). This was also true when comparing the final saturation induction numbers.

The fatigue S/N plot of this alloy is shown in FIG. 19. The fatigue performance of this alloy behaved differently versus the Alloys of Examples 1 and 2. Samples having the lamellar phases had slightly better fatigue strengths than did those with the martensite phase. Factors associated with the slightly lower tensile and yield strengths after ageing treatment were not the predominate factor for the final fatigue performance. Sample 3-13 with lamellar microstructure had a fatigue limit approaching 92 ksi. Samples 3-31 and 3-33 with martensite phase had a fatigue limit of approximately 85 ksi and 88 ksi respectively. These numbers were significantly lower than were those of the Alloys of Examples 1 and 2, but were still comparable to the fatigue limits of the majority of the commercial high strength steels.

In summary, the sample Alloy of Example 3 with proper solution heat treatment and ageing precipitation had mechanical properties comparable to or better than the majority of high strength steels. Samples of the Alloy of Example 3 exhibited a tensile strength exceeding 185 ksi, yield strengths exceeding 165 ksi, elongation exceeding 15%, and a magnetic saturation induction exceeding 22 KG. The potential heat treating brittleness problems did not exist in this alloy. In addition, this alloy, even at an over-aged condition, had a minimum fatigue limit of approximate 84 ksi. This alloy, due to its low-carbon nature, has relatively broader processing windows to render the optimal final properties.

Various modifications of the invention are contemplated which will be obvious to those skilled in the art and can be resorted without departing from the spirit and scope of the invention as defined by the following claims.

What is claimed is:

1. A method for producing a high strength metal alloy having high magnetic saturation induction comprising the steps of:

melting together in a vacuum or protective atmosphere in percent by weight an alloy mixture consisting essentially of: about 20% to about 35% Co; about 2% to about 6% Ni; 0% to about 0.15% C; about 0.75% to about 3% Mo; 0% to about 3.0% Cr; 0% to about 2% Mn; with the balance comprised of Fe;

forming the alloy melt into at least one billet;

homogenizing said billet under a protective atmosphere;

hot rolling the homogenized billet to plate;

normalizing or solution heat treating said plate under a vacuum or inert gas protective atmosphere;

quenching the normalized or solution heat treated plate;

precipitation aging the quenched plate; and, cooling the precipitation aged plate to ambient temperature.

2. A method according to claim 1 wherein:

said homogenizing step is conducted at a temperature of about 400° F. to about 500° F. lower than the melting point of said alloy mixture;

said hot rolling step has a beginning rolling temperature in the range of about 2000° F. to about 2100° F. and a finishing rolling temperature of at least about 1600° F. when the specific desired thickness is achieved;

said solution heat treating step is conducted at a temperature of about 1500° F. to about 1700° F.;

said quenching step is conducted from said solution heat treating temperature to below about 300° F.; said steps further comprising:

chilling the quenched plate by immersion in a sub-zero bath;

warming the chilled plate to ambient temperature prior to precipitation aging of said chilled plate; and, wherein said precipitation aging of the warmed plate is conducted at a temperature in the range of about 800° F. to about 1100° F. for at least about 6 hours.

3. A method according to claim 1 wherein:

said homogenizing step is conducted at a temperature in the range of about 2,150±50° F.; and, said precipitation aging step is conducted at a temperature in the range of about 950±10° F. to about 1015° F.±10° F. for about 8 to about 36 hours.

4. A method according to claim 2 wherein:

said solution heat treating step is conducted at a temperature of about 1530° F. to about 1650° F. for a minimum of one hour per half inch;

said chilling step in a sub-zero bath is for a minimum of 1 hour at a temperature of less than about −100° F.; and, said alloy mixture consists essentially of about 23% to about 29% Co; about 2% to about 6% Ni; about 0.01% to about 0.15% C; about 0.75% to about 3% Mo; about 0.5% to about 3% Cr; 0% to about 2% Mn; 0% to about 0.02% Si; 0% to about 0.003% P; 0% to about 0.001 % S; 0% to about 0.005% $O_2$+$N_2$; with the balance Fe.

5. A method according to claim 4 wherein:

said carbon in said alloy mixture is present in an amount of about 0.01 % to about 0.13%; and, said homogenizing step is conducted for about 24 hours.

6. A method according to claim 1 wherein:

said high strength metal alloy mixture consists essentially of, in percent by weight:

about 25% to about 26% Co; about 4.5% to about 5.5% Ni; about 0.13% to about 0.1 5% C; about 1.9% to about 2.1 % Mo; about 0.9% to about 1.1 % Cr; 0% to about 0.05% Mn; 0% to about 0.02% Si; 0% to about 0.003% P; 0% to about 0.001% S, 0% to about 0.005% $O_2$+$N_2$; with the balance Fe.

7. A method according to claim 1 wherein said high strength metal alloy mixture consists essentially of, in percent by weight:

about 25% to about 26% Co; about 4.5% to about 5.5% Ni; about 0.04% to about 0.10% C; about 1.9% to about 2.1% Mo; about 0.9% to about 1.1% Cr; 0% to about 0.05% Mn; 0% to about 0.02% Si; 0% to about 0.003% P; 0% to about 0.001 % S, 0% to about 0.005% $O_2$+$N_2$; with the balance Fe.

8. A method according to claim 1 wherein said high strength metal alloy mixture consists essentially of, in percent by weight:

about 25% to about 26% Co; about 4.5% to about 5.5% Ni; about 0.01 % to about 0.03% C; about 1.0% to about 1.2% Mo; about 1.2% to about 1.4% Cr; 0% to about 0.05% Mn; 0% to about 0.02% Si; 0% to about 0.003% P; 0% to about 0.001% S, 0% to about 0.005% $O_2$+$N_2$; with the balance Fe.

9. A method for producing a high strength metal alloy having high magnetic saturation induction comprising the steps of:

A1. melting together in a vacuum or protective atmosphere in percent by weight an alloy mixture consisting essentially of: about 20% to about 35% Co; about 2% to about 6% Ni; 0% to about 0.15% C; about 0.75% to about 3% Mo; 0% to about 3.0% Cr; 0% to about 2% Mn; with the balance comprised of Fe;

B. forming the alloy melt into at least one billet;

C. homogenizing said billet under a protective atmosphere at a temperature in the range of about 400° F. to about 500° F. lower than the melting point of the alloy;

D. hot rolling the homogenized billet to plate with a beginning rolling temperature in the range of about 2000° F. to about 2100° F. and a finishing rolling temperature of at least about 1600° F. when the specific desired thickness is achieved;

E. normalizing or solution heat treating said plate at a temperature in the range of about 1500° F. to about 1700° F. for a minimum of one hour per half inch under a vacuum or inert gas protective atmosphere;

F. cooling the normalized or solution heat treated plate from said solution heat treating temperature to below about 300° F.;

G. precipitation aging the cooled plate at a temperature in the range of about 800° F. to about 1100° F. for about 6 to about 36 hours; and, H. cooling the precipitation aged plate to ambient temperature.

10. A method according to claim 9 wherein:

in step E, said solution heat treating step is conducted at a temperature in the range of about 1530° F. to about 1650° F.; and, in step F, said cooling from said heat treating temperature comprises quenching in air, or in an inert gas environment.

11. A method according to claim 10 wherein:

in step A1, said melting of said alloy mixture is made by a vacuum induction melting (VIM) process and is followed by step A2, comprising a secondary refining step comprising a vacuum arc remelting (VAR) process to remove gas contents and other impurities, prior to step B, forming said billet; and, in step F, said cooling from said heat treating temperature step further comprises sub-zero treating by immersion in a sub-zero bath.

12. A method according to claim 11 said steps further comprising:

B2. coating said billet with an oxidation resistant coating, and wherein:

in step E, said solution heat treating step is conducted at a temperature in the range of about 1530° F. to about 1650° F.

13. A method for producing a high strength metal alloy having high magnetic saturation induction comprising the steps of, A1. melting together in a vacuum or protective atmosphere in percent by weight an alloy mixture consisting essentially of: about 20% to about 35% Co; about 2% to about 6% Ni; 0% to about 0.15% C; about 0.75% to about 3% Mo; 0% to about 3.0% Cr; 0% to about 2% Mn; with the balance comprised of Fe;

A2. remelting to refine and remove gas contents and other impurities;

A3. casting the melt into at least one ingot;

B1. forging said at least one ingot into at least one billet;

B2. cooling said at least one billet to ambient temperature;

B3. coating the cooled at least one billet with an oxidation resistant coating;

C1. homogenizing the cooled at least one billet by heating to about 500° F. lower than the melting point of the alloy;

C2. removing surface oxides and defects from the homogenized at least one billet;

D1. hot rolling said at least one billet to form at least one plate at an initial temperature in the range of about 2000° F. to about 2200° F. and finishing rolling at least about 1600° F.;

D2. cold rolling said plate;

E. solution heat treating the cold rolled plate at a temperature in the range of about 1500° F. to about 1700° F. for at least 1 hr per ½ inch under a vacuum or inert gas protective atmosphere;

F1. cooling the solution heat treated plate in recirculating inert gas or still air to below about 300° F;

F2. immersing the cooled plate in a sub-zero bath;

F3. warming the plate from step F2 in air to ambient temperature;

G. precipitation aging the warmed plate at about 800° F. to about 1100° F. for at least 6 hrs; and, H. cooling the precipitation aged plate to ambient temperature.

14. A method according to claim 13 wherein:

in step C1, said homogenizing step includes heating to about 2150° F. for about 24 hours.

15. A method according to claim 13 wherein:

in step F1, said cooling step is conducted in recirculating inert gas or still air to below 300° F. within about 30 minutes.

16. A method according to claim 13 wherein:

in step F2, said immersing step is conducted in a sub-zero bath at a temperature of −100° F. for about 1 hr per ½ inch.

17. A method according to claim 13 wherein:

in step A1, said alloy mixture contains from about 0.13% to about 0.15% by weight C;

in step E, said solution heat treating is conducted at 1610° F.;

in step F1, said cooling is by air cooling; and, in step G. said precipitation aging is conducted at a temperature in the range of about 950° F. to about 970° F. for a time in the range of about 14 to about 36 hours.

18. A method according to claim 13 wherein:

in step A1, said alloy mixture contains from about 0.04% to about 0.06% by weight of C;

in step E, said solution heat treating is conducted at a temperature of about 1560° F. to about 1680° F.;

in step F1, said cooling is by air cooling; and, in step G, said precipitation aging is conducted at a temperature of between about 905° F. to about 1025° F. for a period of at least about 8 hrs.

19. A method according to claim 13 wherein:

in step A1, said alloy mixture contains from about 0.01 % to about 0.03% by weight of C;

in step E, said solution heat treating is conducted at about 1540° F. to about 1650° F.;

in step F1, said cooling is by air cooling to ambient temperature; and, in step G, said precipitation aging is conducted at a temperature of about 1000° F. for 18 hours.

20. A method according to claim 13 wherein:

said virgin raw materials of said metal alloy have <0.05% by weight total combined impurity level of S, P, $O_2$, $N_2$, Si, W, V and Nb.

* * * * *